US007983582B2

(12) United States Patent
Hase

(10) Patent No.: US 7,983,582 B2
(45) Date of Patent: Jul. 19, 2011

(54) IMAGE FORMING APPARATUS AND CONTROL METHOD THEREFOR

(75) Inventor: Takamasa Hase, Kawasaki (JP)

(73) Assignee: Ricoh Company, Limited, Tokyo (JP)

( * ) Notice: Subject to any disclaimer, the term of this patent is extended or adjusted under 35 U.S.C. 154(b) by 60 days.

(21) Appl. No.: 12/457,043

(22) Filed: May 29, 2009

(65) Prior Publication Data

US 2009/0297197 A1 Dec. 3, 2009

(30) Foreign Application Priority Data

May 30, 2008 (JP) ..... 2008-143879

(51) Int. Cl.
*G03G 15/20* (2006.01)

(52) U.S. Cl. ..... 399/69; 399/45; 399/334

(58) Field of Classification Search ..... 219/619; 399/69, 334, 45

See application file for complete search history.

(56) References Cited

U.S. PATENT DOCUMENTS

| | | | | |
|---|---|---|---|---|
| 6,246,843 | B1 * | 6/2001 | Nanataki et al. | 399/45 |
| 2005/0067408 | A1 | 3/2005 | Fujii et al. | |
| 2009/0148205 | A1 | 6/2009 | Seo et al. | |
| 2009/0245897 | A1 | 10/2009 | Seo et al. | |

FOREIGN PATENT DOCUMENTS

| | | |
|---|---|---|
| EP | 1 253 483 | 10/2002 |
| EP | 1 582 939 | 10/2005 |
| JP | 2002-023557 | 1/2002 |
| JP | 2005-321642 | 11/2005 |
| JP | 2007-226126 | 9/2007 |
| JP | 2008-040176 | 2/2008 |

OTHER PUBLICATIONS

European Search Report dated Nov. 24, 2009 issued in corresponding European Application No. 09161335.6.

* cited by examiner

*Primary Examiner* — Hoang Ngo
(74) *Attorney, Agent, or Firm* — Harness, Dickey & Pierce, P.L.C.

(57) ABSTRACT

An image forming apparatus includes an image carrier, a developing unit, a transfer unit, and a fixer to fix an image formed on a sheet and includes a rotary heat generator including a heat generation layer, a pressure member to form a nip with the rotary heat generator to sandwich the sheet therebetween, an excitation coil disposed facing the rotary heat generator, to inductively heat the heat generation layer, a demagnetization coil disposed facing the heat generation layer, to generate magnetic flux that partly counteracts magnetic flux generated by the excitation coil and a fixer controller to control activation of the excitation coil as well as the demagnetization coil before a second image formation job after completion of a first image formation job in which an image is formed on a sheet of recording media whose width is smaller than a maximum sheet width usable in the fixer.

20 Claims, 17 Drawing Sheets

FIG. 9

| | | WIDTH OF SHEETS IN CURRENT PRINT JOB | | | | | | |
|---|---|---|---|---|---|---|---|---|
| | | A6-T | B6-T | A5-T | B5-T | A4-T | B4-T | A3-T |
| THRESHOLD TEMPERATURE T (°C) | | 170 | 170 | 170 | 180 | 180 | 190 | - |
| TARGET TEMPERATURE DURING TEMP-EQ MODE (°C) | | 170 | | | | | | |
| ROTATIONAL VELOCITY DURING TEMP-EQ MODE (MM/S) | | 230 | | | | | | |
| DEMAGNETIZATION DUTY (%) | COIL 1 | 100 | 100 | 100 | 100 | 100 | 100 | 0 |
| | COIL 2 | 100 | 100 | 100 | 100 | 60 | 0 | 0 |
| | COIL 3 | 100 | 100 | 50 | 0 | 0 | 0 | 0 |
| NUMBER OF SHEETS DURING CURRENT PRINT JOB | | 10 | | | | | | |
| FIRST CONTROL TIME $t_1$ (s) | | 5 | | | | | | |
| SECOND CONTROL TIME $t_2$ (s) | | 15 | | | | | | |

IMAGE FORMING APPARATUS AND CONTROL METHOD THEREFOR

CROSS-REFERENCE TO RELATED APPLICATIONS

This patent specification claims priority from Japanese Patent Application No. 2008-143879, filed on May 30, 2008 in the Japan Patent Office, the entire contents of which are hereby incorporated by reference herein.

BACKGROUND OF THE INVENTION

1. Field of the Invention

The present invention generally relates to an image forming apparatus, such as a copier, a printer, a facsimile machine, or a multifunction machine, that includes a fixer, and a fixing method, and more particularly, to an electromagnetic induction heating fixer, an image forming apparatus including the same, and a fixing method using the same.

2. Discussion of the Background Art

In general, an electrophotographic image forming apparatus, such as a copier, a printer, a facsimile machine, and a multifunction machine including at least two of those functions, forms an electrostatic latent image on an image carrier, develops the latent image with developer such as toner, and transfers the developed image from the image carrier onto a sheet of recording media, such as paper, overhead projector (OHP) film, and the like, after which, the developed image (toner image) is fixed on the sheet.

A fixer is a mechanism that typically includes a rotary fixing member such as a fixing roller and a pressure roller that presses against the fixing roller. The fixing member is heated by a heat source, typically but not necessarily internal to the fixing member, and the fixing member and the pressure roller together sandwich the sheet between them to form a fixing nip where the image formed on the sheet is fixed on the sheet with heat and pressure. This method is hereinafter referred to as the heating-roller fixing method.

Recently, various approaches described below have been tried to reduce warm-up time of fixers, thereby reducing energy consumption and waiting time for users. For example, thickness of the fixing roller is reduced or a bubble layer is included in the fixing roller. Alternatively, a fixing member such as an endless belt or film whose heat capacity is smaller than a roller is used. Separately, an electromagnetic induction-heating fixing method has been proposed.

An electromagnetic induction-heating fixer generally includes a so-called excitation coil through which a high-frequency electrical current is passed so as to generate a magnetic flux, and a magnetic core for guiding the magnetic flux to a roller-shaped or belt-shaped heat generator efficiently. A fixing nip can be formed by the heat generator and a pressure roller that presses against the heat generator either directly or indirectly via a fixing member. When the pressure roller presses against the heat generator directly, the heat generator serves as the fixing member.

The magnetic flux causes an eddy current in the heat generator, and thus the heat generator is heated inductively. In this configuration, the heat generator can be promptly heated because the heat generator itself can generate heat, eliminating preheating that is required in the heating-roller fixing method. Thus, the electromagnetic induction-heating fixing method is advantageous in that both warm-up time and energy consumption can be reduced.

However, the electromagnetic induction-heating fixing method still has a problem described below in detail.

Generally, the image forming apparatus can accommodate a variety of different sheet sizes. When sheets whose length in an axial direction of the heat generator (hereinafter simply "width of the sheet") is relatively small pass through the fixing nip continuously, lateral end portions of the heat generator (or the fixing member including such a heat generator) where the sheets do not pass (hereinafter also "non-sheet area") tend to overheat.

This is because, although the heat capacity of a typical heat generator is relatively small, heat is drawn from a center portion in the axial direction of the heat generator where the sheet passes (hereinafter "center portion" or "sheet area") by the sheets whereas heat from the lateral end portions where the sheets do not pass is not lost, inviting overheating in the end portions of the heat generator (hereinafter also simply "peripheral overheating"). Such overheating can degrade or even damage the heat generator.

This peripheral overheating and its resultant uneven temperature distribution have consequences for image quality. Thus, when a sheet whose width is larger than that of the small sheets described above passes through the fixing nip after the small sheets have passed the fixing nip continuously for some time, the level of gloss in a resulting image will be different between a portion fixed by the center portion and a portion fixed by the lateral end portions of the heat generator. If such overheating in the end portions of the heat generator is significant, toner in the resulting image will be partly absent from portions that pass the overheated end portions of the heat generator, which is a phenomenon called hot offset. Hot offset occurs because, when toner is heated excessively, cohesion among toner particles is lower than adhesion between the toner particles and the fixing member, thereby, causing toner layers to separate.

In view of the foregoing, one known technique uses sub-induction coils or demagnetization coils to counteract the magnetic flux generated by a main induction coil or excitation coil. The demagnetization coils are respectively provided in end portions of the heat generator except a sheet area to be covered by a sheet whose width is smallest (hereinafter "smallest sheet") among multiple different sheet sizes that the image forming apparatus can accommodate. Then, during a fixing operation, the amount of heat generated in the non-sheet areas is reduced from that generated in the sheet area, thus restricting overheating of the heating generator.

In another known method, activation of the demagnetization coils is adjusted according to sheet size because heating might be insufficient if the demagnetization coils are constantly on.

However, in these methods, when small sheets are continuously passed through the fixing nip, even when the demagnetization coils restrict the excessive temperature rise of the heating generator, the temperature of the non-sheet area is higher than that of the sheet area. Therefore, when a relatively large sheet is passed through the fixing nip immediately after small sheets are continuously passed through the fixing nip, the gloss level can be uneven between the center portion and the lateral end portions of the sheet.

In view of the foregoing, there is a need to equalize temperature distribution in the sheet width direction or axial direction of the heat generator after small sheets are continuously passed through the fixer, which the known methods fail to do.

SUMMARY OF THE INVENTION

In view of the foregoing, in one illustrative embodiment of the present invention, an image forming apparatus includes an image carrier on which an electrostatic latent image is formed, a developing unit disposed facing the image carrier to develop the electrostatic latent image with developer, a transfer unit to transfer the developed image onto a sheet of recording media, and a fixer to fix the image on the sheet. The fixer includes a rotary heat generator including a heat generation layer, a pressure member to form a nip with the rotary heat generator to sandwich the sheet therebetween, an excitation coil disposed facing the rotary heat generator, to inductively heat the heat generation layer, a demagnetization coil disposed facing the heat generation layer, to generate magnetic flux that partly counteracts magnetic flux generated by the excitation coil, and a fixer controller to control activation of the excitation coil as well as the demagnetization coil before a second image formation job after completion of a first image formation job in which an image is formed on a sheet of recording media whose width is smaller than a maximum sheet width usable in the fixer.

In another illustrative embodiment of the present embodiment provides a control method for the image forming apparatus described above. The control method includes completing a first image formation job, detecting a temperature of a center portion and an end portion of the rotary heat generator, and, based on the detected temperature, controlling activation of the excitation coil as well as the demagnetization coil before start of a second image formation job following the first image formation job in which an image is formed on a sheet of recording media whose width is smaller than a maximum sheet width usable in the fixer so as to reduce a difference in temperature between the center portion and the end portion of the rotary heat generator.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 6A illustrates demagnetization effects in the fixer shown in FIG. 3 when the demagnetization coil units are on;

FIG. 9 is a table of examples of parameters used for a temperature equalization mode;

DETAILED DESCRIPTION OF PREFERRED EMBODIMENTS

Figure 1:
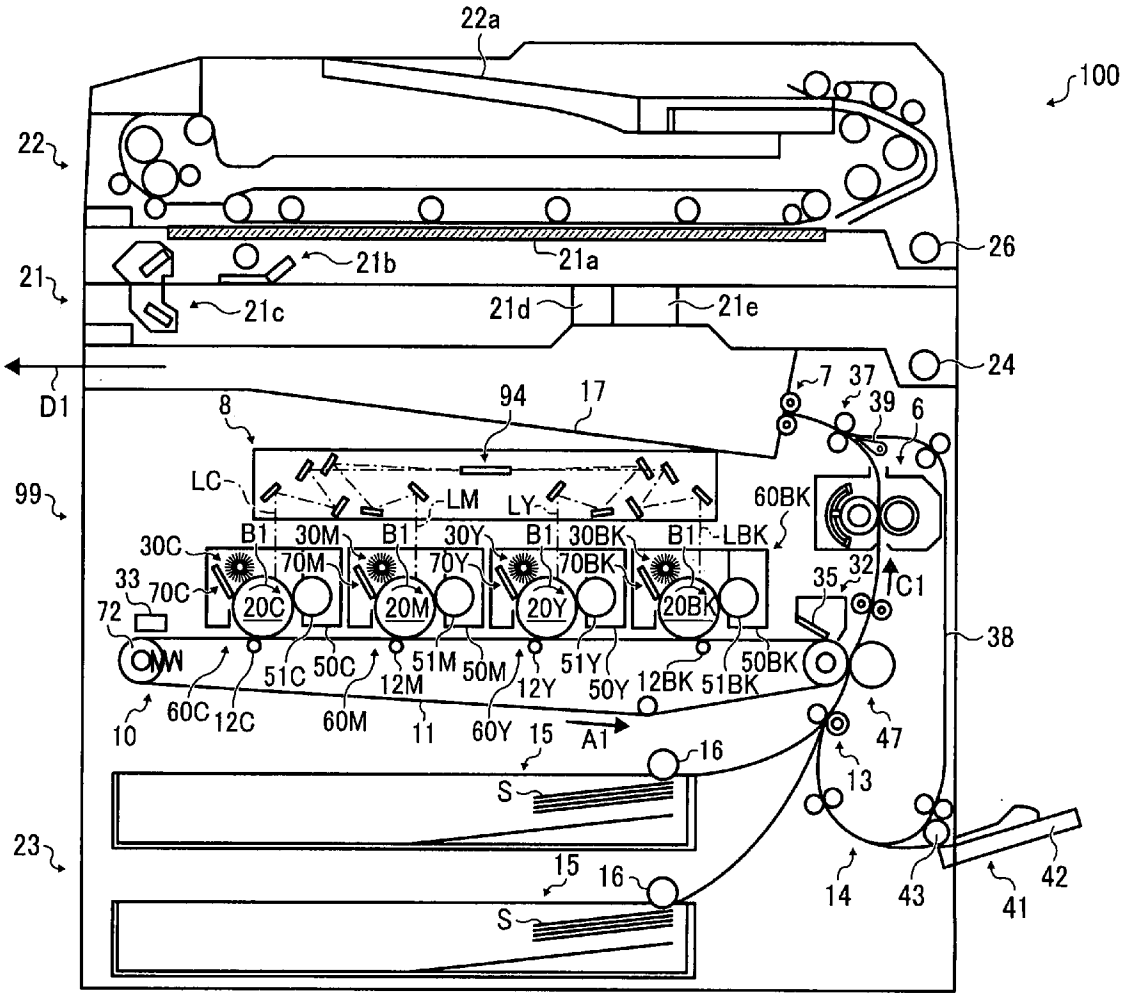
FIG. 1 illustrates a configuration of an image forming apparatus according to an illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an illustrative embodiment of the present invention is described.

FIG. 1 is a schematic diagram illustrating a configuration of an image forming apparatus 100, and the right and the left in FIG. 1 are respectively a front side and a back side of the image forming apparatus 100.

In the present embodiment, the image forming apparatus 100 is a multifunction machine that functions as a copier, a printer, and a fax machine and capable of multicolor mage forming. When the image forming apparatus 100 functions as a printer or fax machine, the image forming apparatus 100 performs image formation according to image signals converted from image information that is transmitted from an external device such as a computer.

The image forming apparatus 100 can form images on sheets of recording media (hereinafter "sheets S") such as OHP (Overhead Projector) film, cardboard such as postcards, and envelopes as well as typical paper used for copying. Additionally, the image forming apparatus 100 is capable of both single-side printing in which an image is formed only on a first side of the sheet S and duplex printing in which images are formed on both sides of the sheet S.

Referring to FIG. 1, the image forming apparatus 100 is a tandem-type image forming apparatus employing an intermediate transfer (indirect transfer) method, and multiple cylindrical photoreceptors 20BK, 20Y, 20M, and 20C are disposed in parallel therein. The photoreceptors 20BK, 20Y, 20M, and 20C serve as latent image carriers, and black, yellow, magenta, and cyan toner images whose colors are decomposed single-colors of a multicolor image are formed on the respective photoreceptors 20BK, 20Y, 20M, and 20C.

It is to be noted that reference characters BK, Y, M, and C respectively represent black, yellow, magenta, and cyan, and hereinafter may be omitted when color discrimination is not necessary.

The image forming apparatus 100 includes a main body 99 disposed in a center portion in a vertical direction, a reading unit or scanner 21 that is disposed above the main body 99 and reads image information of an original document, an ADF (Automatic Document Feeder) 22 disposed above the reading unit 21, a sheet feeder 23 disposed beneath the main body 99, and a manual feed unit 41 provided on a right side wall of the main body 99 in FIG. 1. The sheet feeder 23 serves as a sheet feed table and forwards the sheets S contained therein to the main body 99.

The main body 99 includes four image stations 60BK, 60Y, 60M, and 60C respectively including the photoreceptors 20BK, 20Y, 20M, and 20C, a transfer unit 10 disposed beneath the four image stations 60, and a secondary transfer unit 47. The transfer unit 10 serves as an intermediate transferer and includes an endless intermediate transfer belt 11 that is disposed in a center portion of the main body 99. The intermediate transfer belt 11 is looped around a roller 72 and other rollers and rotated in a direction indicated by arrow A1 shown in FIG. 1 (hereinafter also "belt rotation direction").

The four image stations 60BK, 60Y, 60M, and 60C serves as image forming units for forming black, yellow, magenta, and cyan toner images. The photoreceptors 20 have an identical or similar diameter, and the diameter is 24 mm in the present embodiment. The photoreceptors 20BK, 20Y, 20M, and 20C are arranged at an identical or similar intervals along an outer circumferential surface, that is, an image formation surface, of the intermediate transfer belt 11 in that order in the direction indicated by arrow A1 shown in FIG. 1.

Each image station includes a charger 30 for charging a surface of the photoreceptor 20 uniformly, a developing unit 50 provided with a developing roller 51, and a cleaning blade 70 for cleaning the surface of the photoreceptor 20 are arranged clockwise that is a direction indicated by arrow B1 around the photoreceptor 20. The developing unit 50 develops an electrostatic latent image formed on the photoreceptor 20 with toner into a toner image.

The toner images, that is, visualized images, formed on the photoreceptors 20BK, 20Y, 20M, and 20C are primarily transferred therefrom and superimposed one on another on the intermediate transfer belt 11 into a multicolor image, and then the multicolor image is secondarily transferred onto a surface of the sheet S.

Primary transfer rollers 12BK, 12Y, 12M, and 12C serving as transfer chargers are disposed facing the respective photoreceptors 20BK, 20Y, 20M, and 20C via the intermediate transfer belt 11. The transfer rollers 12 sequentially apply transfer bias voltages to the intermediate transfer belt 11 so as to transfer the toner images from the respective photoreceptors 20 and superimpose them one on another on an identical or similar portion of the intermediate transfer belt 11 as the intermediate transfer belt 11 rotates.

The intermediate transfer belt 11 is preferably an endless belt made of resin film produced by dispersing a electrical conductive material such as carbon black in a material such as PVDF (polyvinylidene fluoride), ETFE (ethylene tetrafluoroethylene copolymer), PI (polyimide), PC (polycarbonate), TPE (thermoplastic elastomer), and the like. In the present embodiment, the intermediate transfer belt 11 is a single-layered belt produced by adding carbon black to TPE whose modulus of elongation is within a range from 1000 MPa to 2000 MPa and has a thickness of within a range from 100 μm to 200 μm and a width of about 230 mm.

The image forming apparatus 100 further includes a belt cleaner 32, a toner mark sensor 33, an optical unit 8 disposed above the image stations 60, serving as a latent image forming unit, a pair of registration rollers 13, a waste toner container, not shown, disposed beneath the transfer unit 10, and a toner transport path, not shown, that connects together the belt cleaner 32 and the waste toner container.

The belt cleaner 32 is disposed between the secondary transfer unit 47 and the image station 60BK in the direction indicated by arrow A1 shown in FIG. 1, facing the intermediate transfer belt 11, and includes a cleaning blade 35 that contacts the intermediate transfer belt and faces the roller facing the secondary transfer unit 47 via the intermediate transfer belt 11. The cleaning blade 35 removes any toner and paper dust remaining on the intermediate transfer belt 11 after the toner image is transferred therefrom.

The optical unit 8 is a laser beam scanner using laser diodes as light sources and scans surfaces of the photoreceptors 20BK, 20Y, 20M, and 20C with respective laser beams LBK, LY, LM, and LC according to image information, thus forming electrostatic latent images thereon. Alternatively, the optical unit 8 can use a LED (Light-Emitting Diode) as a light source. The toner mark sensor 33, disposed downstream from the image station 60C in the direction indicated by arrow A1, faces the outer surface of the intermediate transfer belt 11.

The registration rollers 13 stop the sheet S fed from the sheet feeder 23 and then forward the sheet S to a secondary transfer position between the intermediate transfer belt 11 and the secondary transfer unit 47, timed to coincide with image formation in the respective image stations 60. A detector, not shown, detects that a leading edge of the sheet S reaches the registration rollers 13.

The image forming apparatus 100 further includes a fixer 6 disposed downstream from the secondary transfer unit 47 in a direction in which the sheet S is transported (hereinafter "sheet transport direction"), a pair of discharge rollers 7, a sheet reverse unit 14, a sheet discharge tray 17, and toner bottles, not shown, that contain black, yellow, magenta, and cyan toners, respectively.

The fixer 6 is an electromagnetic induction heating fixer that fixes the toner image on the sheet S that is transported in a direction indicated by arrow C1 shown in FIG. 1. The discharge rollers 7 discharge the sheet S onto the sheet discharge tray 17 after the sheet S passes through the fixer 6. The discharge rollers 7 can rotate reversely, controlled by the controller 90 shown in FIG. 2.

The sheet reverse unit 14 is disposed between the fixer 6 and the discharge rollers 7 and reverses the transport sheet S. More specifically, the sheet reverse unit 14 includes a pair of transport rollers 37 that can rotate in both normal and reverse directions in synchronization with the discharge rollers 7, controlled by the controller 90, a reverse transport path 38, and a switch pawl 39. In duplex printing, the discharge rollers 7 as well as the transport rollers 37 rotate reversely after an image is formed and fixed on a first side of the sheet S. In this time, the switch pawl 39 guides the sheets S to the reverse transport path 38 through which the sheet S is transported reversely from the transport rollers 37 to the registration rollers 13, bypassing the fixer 6.

Figure 2:
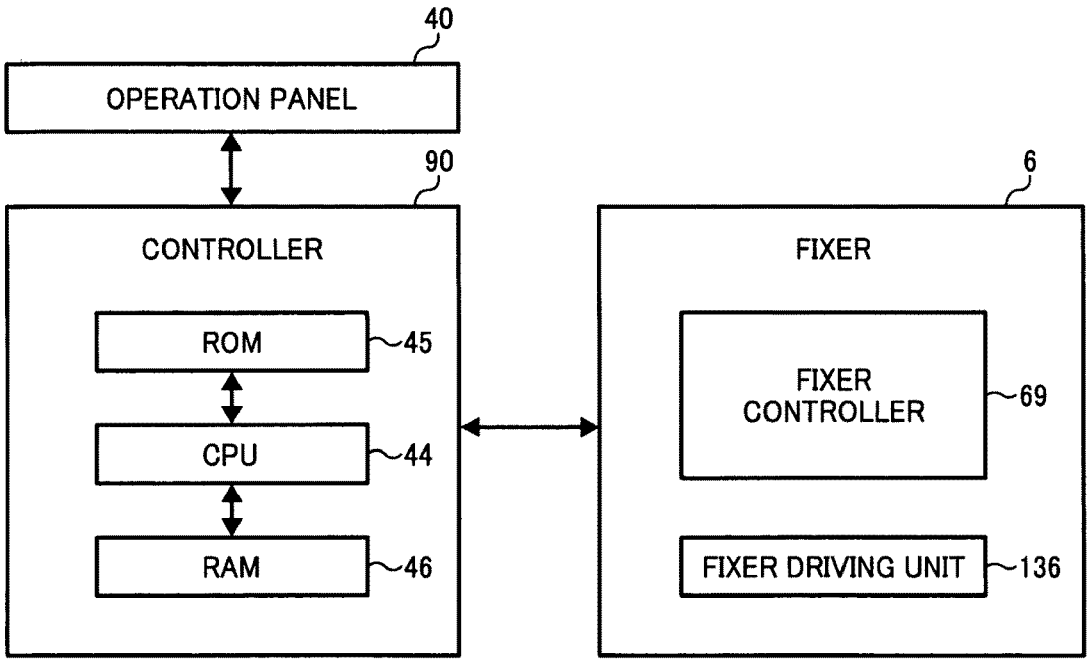
FIG. 2 is a block diagram that schematically illustrates a control system of the image forming apparatus shown in FIG. 1.

The image forming apparatus 100 further includes an operation panel 40 and a controller 90 both shown in FIG. 2. A user can operate the image forming apparatus 100 using the operation panel 40. The controller 90 exerts overall control of the image forming apparatus 100 including the image stations 60.

This image forming apparatus 100 is housing-internal discharge type, that is, the sheet discharge tray 17 is provided inside a housing thereof, above the main body 99 and beneath the reading unit 21. The user can remove the sheets S from the discharge tray 17 downstream in a direction indicated by arrow D1, that is, to the left in FIG. 1.

The reading unit 21 disposed above the main body 99 is hinged to the main body 99 with a shaft 24 disposed on an upstream end portion in the direction indicated by arrow D1 shown in FIG. 1, that is, in a back side portion of the image forming apparatus 100. Thus, the reading unit 21 can be lifted to open with respect to the main body 99.

The reading unit 21 includes a contact glass 21*a*, a first carriage 21*b* that moves from side to side in FIG. 1, a second carriage 21*c*, an imaging lens 21*d*, a reading sensor 21*e*, and the like.

The first carriage 21*b* includes a light source, not shown, that emits light to the original document placed on the contact glass 21*a*, and a first reflector, not shown, that reflects the light reflected on a surface of the original document. The second carriage 21*c* includes a second reflector, not shown, that reflects the light reflected by the first reflector. The imaging lens 21*d* focuses the light reflected by the second reflector on the reading sensor 21*e*, and thus the reading sensor 21*e* reads image information of the original document.

Subsequently, the exposure unit 8 directs laser lights emitted from laser diodes, not shown, onto the surfaces of the photoreceptors 20, forming electrostatic latent images thereon. It is to be noted that the laser lights from the laser diodes can be directed onto the photoreceptors 20 via a known polygon mirror and lenses, not shown.

The ADF 22 disposed above the reading unit 21 is hinged to the reading unit 21 with a shaft 26 disposed on an upstream end portion in the direction indicated by arrow D1 shown in FIG. 1, that is, in the back side portion. Thus, the ADF 22 can be lifted to open with respect to the reading unit 21.

The ADF 22 includes a document table 22*a* on which an original document is placed, and a driving unit, not shown, that is provided with a motor and transports the original document from the document table 22*a* to the contact glass 21*a* of the reading unit 21.

When an original document is copied using the image forming apparatus 100, the user sets the original document on the document table 22*a*. Alternatively, the user lifts the ADF 22, places the original document on the contact glass 21*a* manually, and then lowers the ADF 21 to hold the original document with it. The ADF can open to an angle of about 90 degrees with the reading unit 21, which facilitates setting the original document on the contact glass 21*a*, maintenance of the contact glass 21*a*, and the like.

The sheet feeder 23 includes two vertically-aligned sheet cassettes 15 each of which provided with a feed roller 16 to send out the sheet S from the sheet cassette 15, and a sheet size detector, not shown, to detect the size of the sheets S contained in the sheet cassette 15. Each sheet cassette 15 can accommodate various sizes of the sheets S placed lengthwise or sideways, that is, placed with their shorter side along the sheet transport direction, which is perpendicular to a main scanning direction or a sheet width direction. In the present embodiment, it is assumed that different sized sheets S are contained in the respective sheet cassettes 15.

More specifically, the upper sheet cassette 15 contains relatively small sheets S placed lengthwise, for example, B5-T sheets S, and the lower sheet cassette 15 contains relatively large sheets S placed sideways, for example, A3 sheets S.

It is to be noted that reference characters "A3", "A4", "B4", and "B5" respectively represent standard sheet sizes, and "T" attached thereto means that that sheet is placed lengthwise.

A maximum sheet size and a minimum sheet size that each sheet cassette 15 can accommodate are A3-T or a sheet size slightly larger than A3-T, and postcard-T, respectively. These sheet sizes are determined in view of a maximum image area in the image forming apparatus 100 and typical image sizes.

Additionally, in the present embodiment, the sheets S are centered in the sheet width direction in each sheet cassette 15 because the toner image formed on the photoreceptors 20 and the intermediate transfer belt 11 are centered thereon in the sheet width direction. Therefore, the sheet S fed to the fixer 6 is centered in the sheet width direction. Thus, the sheet S is centered in the sheet width direction (hereinafter "center alignment") constantly from when the sheet S is transported from the sheet feeder 23 until the sheet S is discharged onto the discharge tray 17.

It is to be noted that the center alignment means that a center portion of the sheet S in the sheet width direction is aligned with that of the image area of the photoreceptors 20 and the intermediate transfer belt 11. There is another type of alignment, edge alignment, in which the sheet S is placed with its edge portion in the sheet width direction aligned with that of the image area.

A configuration of the above-described sheet size detector, not shown, can be any known configuration as long as it can detect the sheet size and its alignment, lengthwise or sideways. Alternatively, instead of or together with the sheet size detector provided to the sheet cassette 15, the image forming apparatus 100 can use a sheet size key provided in the operation panel 40, shown in FIG. 2, or a sheet size selection function provided in an external device such as a computer to designate the size of the sheet S on which an image is to be formed.

The manual feed unit 41 includes a manual tray 42, a feed roller 43 that contacts the top of the sheets S stacked on the manual tray 42, and a sheet detector, not shown, that has a configuration similar to that of the sheet size detector provided to the sheet cassette 15. The sheet detector can detect that a sheet S is placed on the manual tray 42 as well as its size. Similarly to the sheet cassettes 15, a maximum sheet size and a minimum sheet size that the manual tray 42 can accommodate are A3-T or a sheet size slightly larger than A3-T, and postcard-T, respectively.

The feed roller 43 rotates clockwise in FIG. 1, thus feeding the sheets S stacked on the manual tray 42 from the top to the reverse transport path 38. Then, the registration rollers 13 stop the sheet S. For example, the manual tray 42 can be used for feeding sheets whose size is different from those of the sheets S contained in the sheet cassettes 15.

The operation panel 40 and the controller 90 are described in further detail below with reference to FIG. 2.

The controller 90 is communicably connected to both the operation panel 40 and the fixer 6. Although not shown in figures, the operation panel 40 includes a single-side printing key, a duplex printing key, numeric keys, a print start key, the sheet size key, and the like. The user can select either single-side printing or duplex printing using the single-side printing key or the duplex printing key, designate the number of copies using the numeric keys, and select the size of the sheet S on which an image is to be formed. Then, the user instructs the image forming apparatus 100 to start image forming by pressing the print start key.

The controller 90 includes a CPU (Central processing Unit) 44, a ROM (Read-Only Memory) 45 serving as a first memory that stores operation programs of the image forming apparatus 100 and various data required for those operation programs, a RAM (Random Access Memory) 46 serving as a second memory that stores data required for operations of the image forming apparatus 100, and the like.

The fixer 6 includes a fixer controller 69 to exert overall control of the fixer 6, and a fixer driving unit 136 that is controlled by the fixer controller 69 and includes a motor to drive the pressure roller 63, and the like.

The sheet size detected by the sheet size directors of the sheet cassettes 15, and the like is input to the controller 90 and further to the fixer controller 69 via the controller 90. Thus, the fixer controller 69 acquires the sheet size and performs control described below according to the sheet size.

It is to be noted that, although the fixer controller 69 and the controller 90 of the image forming apparatus 100 exchange the signals such as sheet size detection signals, temperature detection signals, and the like in the present embodiment, alternatively, the controller 90 can function as the fixer controller as well.

The fixer 6 is described in further detail below with reference to FIG. 3 which is an end-on view of the fixer 6.

Figure 3:
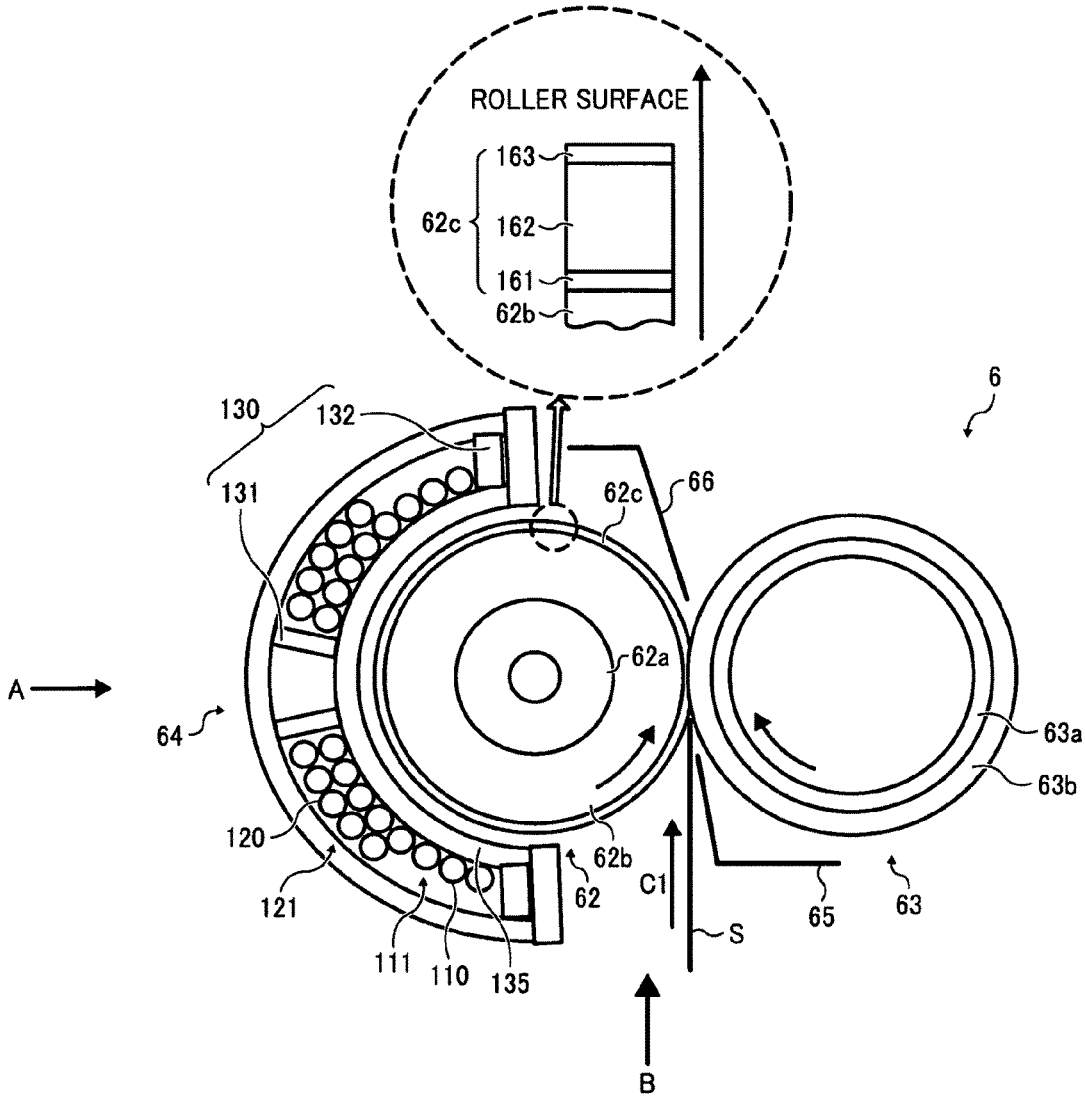
FIG. 3 is an end-on cross-sectional view illustrating a configuration of a fixer included in the image forming apparatus shown in FIG. 1.

Referring to FIG. 3, a fixer 6 includes a fixing roller 62 serving as a fixing member that hears the sheet S and the image formed thereon, a pressure roller 63 serving as a rotary pressurizer that presses against the fixing roller 62, and an induction heating unit 64 disposed facing the fixing roller 62. The fixing roller 62 and the pressure roller 63 together transport the sheet S in a direction indicated by arrow C1 in FIG. 3, sandwiching the sheet S therebetween. The induction heating unit 64 heats the fixing roller 62 through an electromagnetic induction heating method.

The fixer 6 further includes a guide plate 65 and a separation plate 64. The guide plate 65 guides the sheet S to a fixing nip formed between the fixing roller 62 and the pressure roller 63. When the sheet S passes through the fixing nip, the image is fixed on the surface of the sheet S with heat and pressure. Then, the separation plate 66 separates the sheet S from both the fixing roller 62 and the pressure roller 63 and guides the sheet S outside the fixer 6.

The fixing roller 62 includes a cylindrical metal core 62*a*, an elastic member 62*b* that covers the metal core 62*a*, and a fixing sleeve 62*c* that serves as a rotary heat generator and is disposed outside the elastic member 62*b*. The metal core 62*a* can be formed with a SUS (Still Use Stainless) still, and the like. The elastic member 62*b* serves as a heat insulation layer and can be formed with thermally-resistant elastic solid or foamed silicone rubber, for example.

For example, the fixing roller 62 has an external diameter of about 40 mm, and the elastic member 62*b* has a thickness of about 9 mm and a degree of Asker hardness above an axial of within a range from 30 to 50. The elastic member 62*b* contacts an inner circumferential surface of the fixing sleeve 62*c*, and thus the metal core 62*a* and the elastic member 62*b* together serve a holder holding the thin-layered fixing sleeve 63*c* like a roller. The fixing sleeve 62*c* can rotate with respect to the elastic member 62*b*. It is to be noted that both the metal core 62*a* and the elastic member 62*b* can be rotated by rotation of the fixing sleeve 62*c* because they are not prevented from rotating.

Alternatively, the fixing sleeve 62*c* and the elastic member 62*b* can be bonded together so that they can rotate as a single unit.

The fixing sleeve 62*c* includes a base layer 161 serving as a heat generation layer inductively heated by the induction heating unit 64, an elastic layer 162, and a release layer 163 from inside.

Examples of materials of the base layer 161 include iron, cobalt, nickel, and an alloy including one of more of these metals. A thickness of the base layer 161 can be within a range from 30 μm to 50 μm, for example. The base layer 161 generates heat induced by magnetic flux generated by the induction heating unit 64, thus serving as a heat generation layer.

An elastic material such as silicone rubber is used for the elastic layer 162, and a thickness of the elastic layer 162 can be 150 μm, for example. With this configuration, the fixing roller 62 can have a relatively small heat capacity, and thus good image quality without fixing unevenness can be attained.

The release layer 163 is provided to enhance releasability of toner from the fixing sleeve 62*c* as the fixing sleeve 62*c* directly contacts the toner image on the sheet S. The release layer 163 can be a tube of a fluorine compound such as perfluoro alkoxy (PFA) covering the elastic layer 162, and its thickness can be about 50 μm, for example.

It is to be noted that the materials and the thicknesses of the layers in the fixing roller 62 are not limited to the examples described above.

The pressure roller 63 is described in further detail below.

The pressure roller 63 has an external diameter of 40 mm, for example, and includes a cylindrical metal core 63*a*, a thermally-resistant elastic layer 63*b* lying over the metal core 63*a*, and a release layer, not shown, lying over the elastic layer 63*b* and having a relatively high toner releasability. The metal core 63*a* can be formed with a metal such as copper that has a relatively high thermal conductivity. Alternatively, aluminum, and the like can be used for the metal core 63*a*. The elastic layer 63*b* has a thickness of 2 mm, for example. The release layer can be a tube of a fluorine compound such as PFA covering the elastic layer 63*b*, and its thickness can be about 50 μm, for example.

The pressure roller 63 is rotated by the fixing driving unit 136 shown in FIG. 2 clockwise in FIG. 3, and this rotation rotates the fixing sleeve 62*c* contacting the pressure roller 63. When the excitation coil 110 is activated while the fixing sleeve 62*c* rotates, a portion of the fixing sleeve 62*c* facing the excitation coil 110 and its surrounding area are mainly heated electromagnetically. Then, the fixing sleeve 62 is uniformly heated in its circumferential direction as the fixing sleeve 62 rotates.

Alternatively, the fixing roller 62 and the pressure roller 63 can be connected via a gear so as to transmit driving force of the pressure roller 63 to the fixing roller 62, rotating the fixing roller 62 together with the pressure roller 63.

The induction heating unit 64 is described below in further detail with reference to FIG. 3.

The induction heating unit 64 includes an excitation coil 110 to generate the induction magnetic flux (hereinafter also "excitation flux") that inductively heats the base layer 161, demagnetization coil units 120 that generate magnetic flux (hereinafter also "demagnetizing flux") that partly counteracts the excitation flux generated by the excitation coil 110, a core unit 130 disposed to match both the excitation coil 110 and the demagnetization coil units 120, and a coil guide 135. The coil guide 135 is disposed to partly cover an outer circumferential surface of the fixing sleeve 62*c* and serves as a coil housing containing the excitation coil 110, the demagnetization coil units 120, and the core unit 130.

The excitation coil 110 can be litz wire looped on the coil guide 135 and extends in the sheet width direction, which is a direction perpendicular to a surface of paper on which FIG. 3 is drawn.

The core unit 130 is formed of a ferromagnetic material such as ferrite having a relative permeability of about 2500, for example, and includes a center core 131, and side cores 132 both for forming magnetic flux efficiently toward the fixing sleeve 62*c*. The coil guide 135 includes resin having a relatively high thermal resistivity, and the like.

Demagnetization coil units 120 are described in further detail below with reference to FIG. 4.

Figure 4:
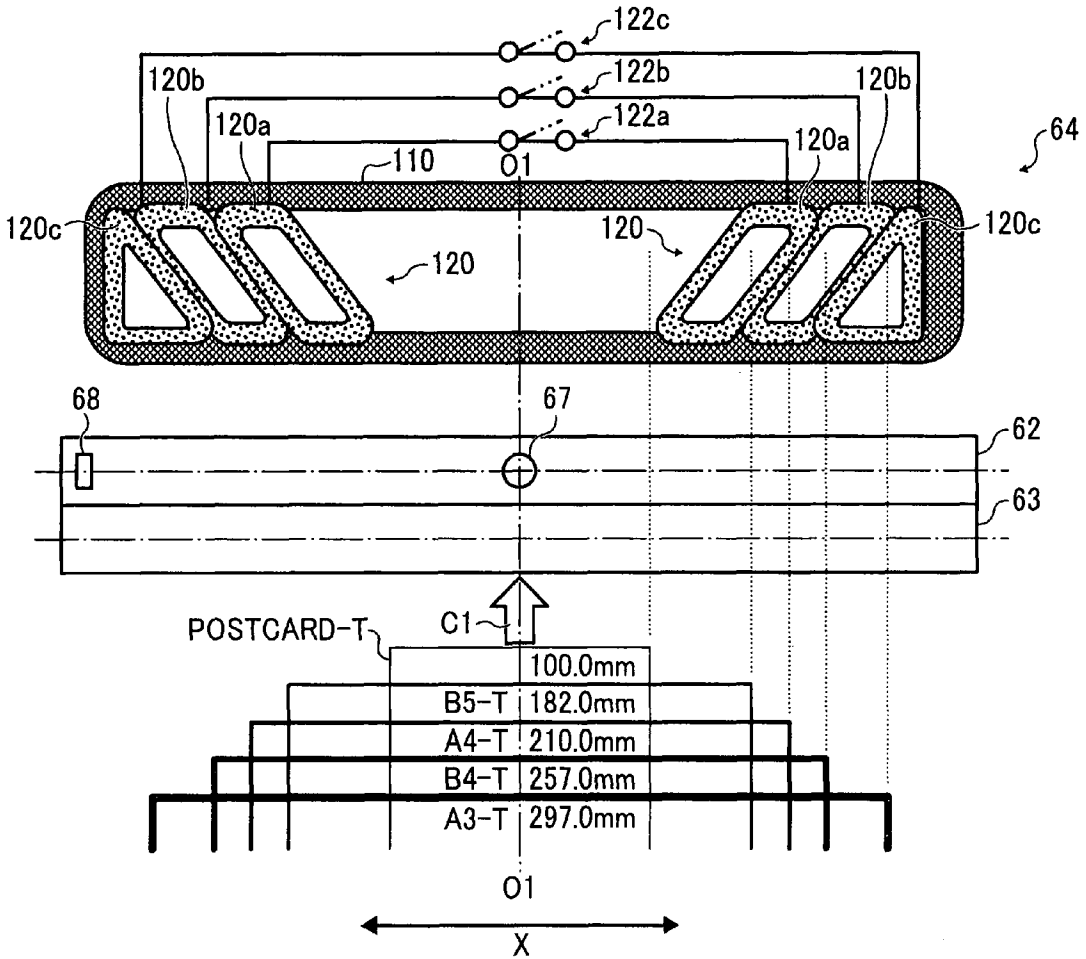
FIG. 4 illustrates locations of an excitation coil, demagnetization coil units, and temperature detectors, and various sheet sizes usable in the image forming apparatus shown in FIG. 1.

In FIG. 4, (a) is the induction heating unit 64 viewed in a direction indicated by arrow A shown in FIG. 3, (b) illustrates the fixing roller 62 and the pressure roller 63 viewed in a direction indicated by arrow B shown in FIG. 3, and (c) shows various different sizes of sheets S to be passed through the fixer 6. In FIG. 4, a reference character X indicates the sheet width direction or an axial direction of the fixing roller 62 and the pressure roller 63.

Referring to FIG. 4, the demagnetization coil units 120 are provided so as to reduce excessive heating (temperature rise) in non-sheet areas where the sheet S does not pass the heating roller 62 by counteracting a part of the excitation flux generated by the excitation coil 110 that acts on the non-sheet area. Therefore, the demagnetization coil units 120 overlap the excitation coil 110 and are disposed in each side of an axis of symmetry or center line O1-O1 in the sheet width direction.

Because sheets are fed in center alignment in the present embodiment, the demagnetization coil units 120 are disposed symmetrically relative to the center portion.

Each demagnetization coil unit 120 includes three demagnetization coils 120*a*, 120*b*, and 120*c* to accommodate various different widths, that is, lengths in the sheet width direction X, of the sheet S. The demagnetization coils 120*a*, 120*b*, and 120*c* of the two demagnetization coil unit 120 are arranged in each side of the axis of symmetry O1-O1.

The induction heating unit 64 further includes switches 122*a*, 122*b*, and 122*c* that are relay switches, a temperature detector 67 serving as a first temperature detector, and a temperature detector 68 serving as a second temperature detector.

An end of the demagnetization coil (litz wire) 120*a*, 120*b*, or 120*c* is connected to an end of the demagnetization coil given an identical reference character and disposed symmetrically, and the other ends of these demagnetization coils given an identical reference character and disposed symmetrically are connected via the switches 122*a*, 122*b*, or 122*c*.

That is, the demagnetization coils 120*a* disposed on both sides of the axis of symmetry O1-O1 are connected via the switch 122*a*. Similarly, the demagnetization coils 120*b* and 120*c* are connected via the switch 122*b* and 122*c*, respectively. Thus, the two demagnetization coils given an identical reference character and disposed symmetrically form a circuit openable and closable by the relay switch.

It is to be noted that, although three demagnetization coils are arranged on each side of the axis of symmetry O1-O1 in the present embodiment, the number of the demagnetization coils can be determined flexibly. For example, only one or two demagnetization coils can be disposed on each side of the axis of symmetry O1-O1.

In the present embodiment, the temperature detector 67 is a non-contact type thermopile disposed to detect a surface temperature of a center portion of the fixing roller 62, and the temperature detector 68 is a contact type thermistor disposed to detect a surface temperature of an end portion in the sheet width direction X of the fixing roller 62.

Alternatively, the temperature detector 67 can be a contact type thermistor, and the temperature detector 68 can be a non-contact type thermistor or thermopile.

The temperature detector 67 is used for controlling activation of the excitation coil 110 and disposed to detect temperature of an area that is the sheet area whatever the sheet size is. In the present embodiment, the temperature detector 67 is disposed in the center portion in the sheet width direction.

The temperature detector 68 is used for controlling the switches 122*a*, 122*b*, and 122*c* of the demagnetization coil units 120 and disposed in an area where the sheet S does not pass even when the sheet S is equal to or larger than A3 sheets, that is, an area outside the width of the maximum sheet that is always the non-sheet area. In the present embodiment, the temperature detector 68 is disposed in an end portion in the sheet width direction or longitudinal direction of the fixing roller 62.

Although, in the present embodiment, the temperature detector 68 is disposed outside the width of the maximum sheet that the fixer 6 can accommodate, alternatively, the temperature detector 68 can be disposed in an end portion of the fixing roller 62 facing the demagnetization coil unit 120.

Additionally, locations of these temperature detectors are not limited to such locations facing the fixing roller 62. For example, these temperature detectors may detect temperature of the fixing roller 62 by measuring temperature of the pressure roller 63 or that of the induction heating unit 64.

The temperature detected by the temperature detector 67 and the temperature detector 68 are input to the fixer controller 69 (shown in FIGS. 2 and 5), and the temperature of the fixing roller 62 is controlled through feedback control based on a first predetermined or given temperature and a fixing target temperature that are described below.

The first predetermined temperature is a target temperature during a temperature equalization mode (hereinafter also "TEMP-EQ mode") described below.

Figure 5:
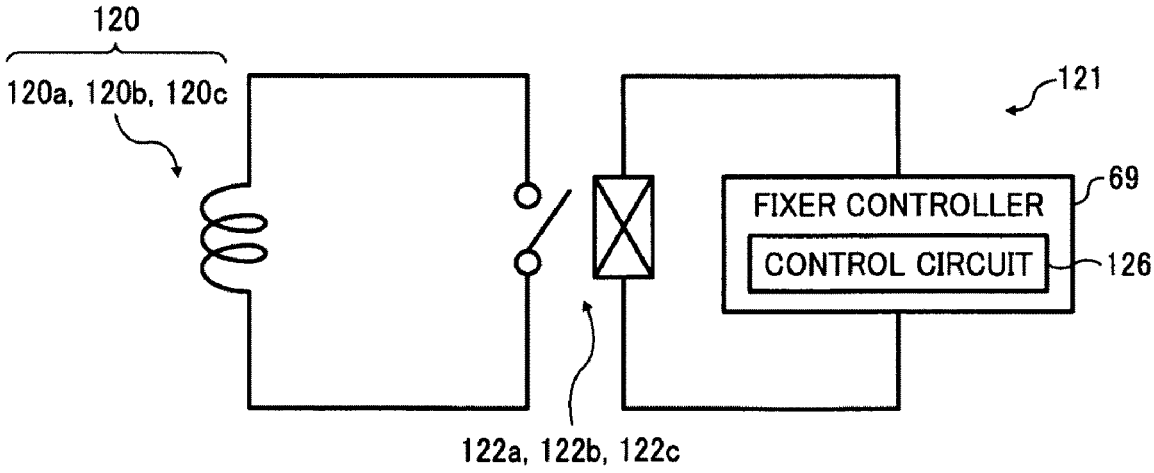
FIG. 5 is a block diagram illustrating a demagnetization circuit.

FIG. 5 illustrates a demagnetization circuit 121.

Referring to FIG. 5, the demagnetization circuit 121 includes the fixer controller 69, the demagnetization coils 120*a*, 120*b*, and 120*c*, and the switches 122*a*, 122*b*, and 122*c*. The fixer controller 69 includes a control circuit 126 that opens and closes the switches 122*a*, 122*b*, and 122*c* independently, thus serving as a demagnetization controller to switch the switches 122*a*, 122*b*, and 122*c* between on and off.

The control circuit 126 is connected to the temperature detector 67 and the temperature detector 68 shown in FIG. 4 and receives the detection signals therefrom. Thus, the control circuit 126 controls activation of the excitation coil 110 as well as activation of the demagnetization coil units 120.

When the control circuit 126 supplies electricity from a commercial power source 127 (shown in FIG. 12) to the excitation coil 110, magnetic force lines whose direction alternate are output in a space facing the excitation coil 110, thus forming an alternate magnetic field. The alternate magnetic field induces eddy current in the base layer 161 of the fixing sleeve 62*c* shown in FIG. 3, and then electrical resistance in the base layer 161 causes Joule heat. Thus, the fixing sleeve 62*c* is heated by induction heating of the base layer 161 therein.

Although the demagnetization circuit 121 shown in FIG. 5 does not include a power source for generating the demagnetization flux that counteracts the excitation flux generated by the excitation coil 110, when the excitation coil 110 is activated in a state in which the switches 122*a*, 122*b*, and 122*c* are closed (short), the demagnetization coils 120*a*, 120*b*, 120*c* respectively generate the demagnetization flux through secondary induction.

Thus, although the demagnetization coil units 120 does not receive electricity directly as described above, turning on at least one of the switches 122*a*, 122*b*, and 122*c* means "activation of the demagnetization coil unit 120 or supplying electricity thereto" in the present specification.

Demagnetization using the demagnetization coil units 120 is described below with reference to FIGS. 6A and 6B.

Figure 6B:
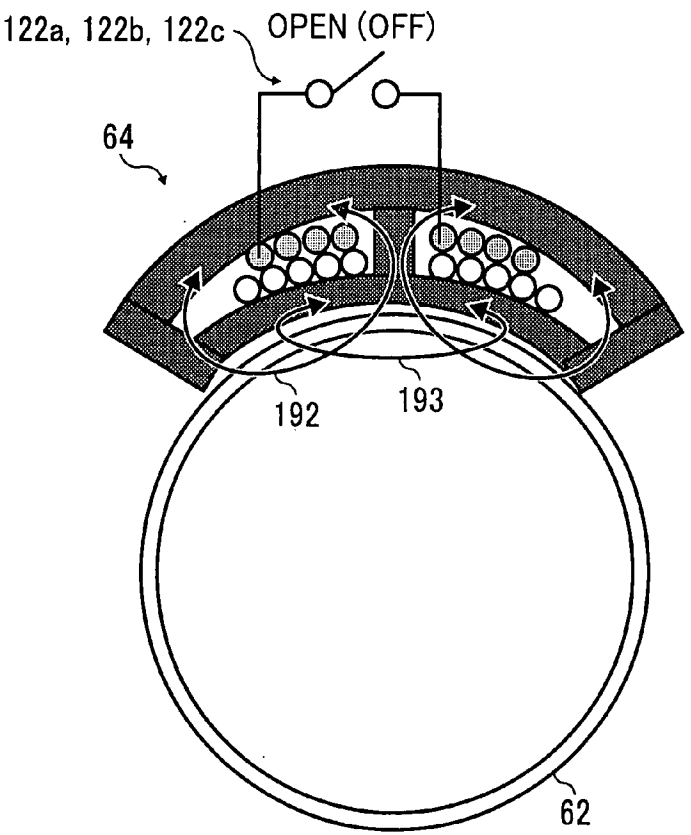
FIG. 6B illustrates demagnetization effects in the fixer shown in FIG. 3 when the demagnetization coil units are off.
Figure 6A:
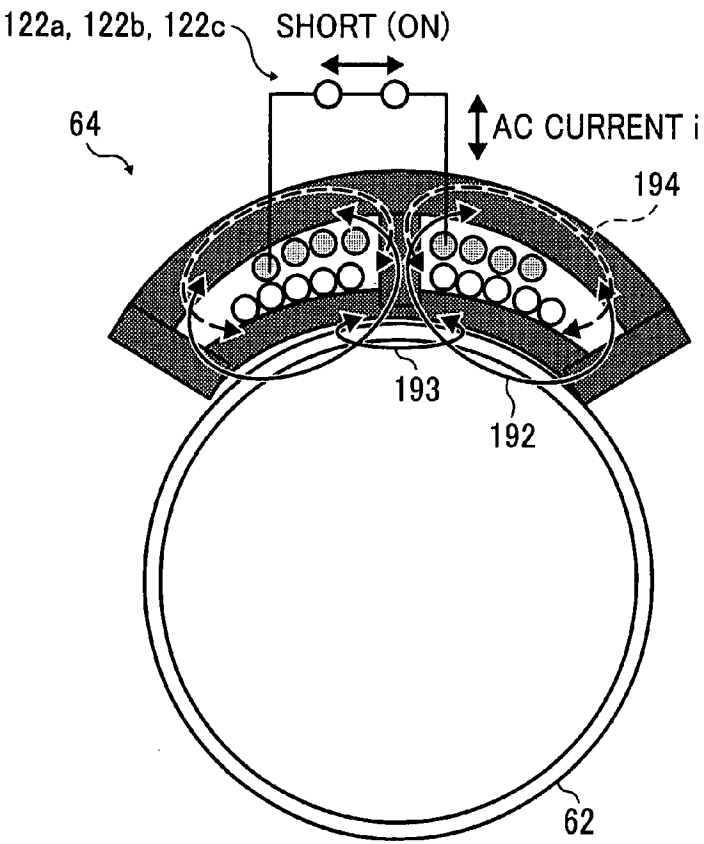

FIGS. 6A and 6B are end-on views in the axial direction and illustrate a demagnetization effect of the demagnetization coil units 120 when the demagnetization coil units 120 are shorted (on) and opened (off), respectively.

In FIGS. 6A and 6B, solid arc arrows 192 represent the inductive magnetic flux (excitation flux) generated by the excitation coil 110, solid arc arrows 193 represent the eddy current generated in the base layer 161, and dotted arc arrows 194 represent demagnetizing flux generated by the demagnetization coil units 120.

When the excitation coil 110 generates the excitation flux, the eddy current 193 is generated, heating the based layer 161. In this time, when the switches 122*a*, 122*b*, and 122*c* of the demagnetization coil units 120 are opened (off) as shown in FIG. 6B, the demagnetization coil units 120 do not generate the demagnetizing flux.

By contrast, when the switches 122*a*, 122*b*, and 122*c* are closed (on) as shown in FIG. 6A, the demagnetization coil units 120 generate the demagnetizing flux 194, thus counteracting the excitation flux 192 generated by the excitation coil 110. As a result, the eddy current 193 is inhibited.

In other words, heat generation in an area of the fixing roller 62 where the demagnetization coils 120*a*, 120*b*, and 120*c* generate the demagnetization flux 194 can be controlled by turning on and off the switches 122*a*, 122*b*, and 122*c*.

In the fixer 6 described above, referring to FIG. 3, when the sheet S on which the toner image is formed is transported in the direction indicated by arrow C1, the guide plate 65 guides the sheet S to the fixing nip (fixing position). In the fixing nip, the toner image is fused by the fixing roller 62 that is heated to a temperature suitable for fixing and then fixed on the sheet S with pressure between the fixing roller 62 and the pressure roller 63, after which the separation plate 66 separates the sheet S from the fixing roller 62, and thus the sheet S leaves the fixing nip as the fixing roller 62 and the pressure roller 63 rotate.

In the above-described fixing operation, heat is thus drawn by the sheet S and the toner image thereon from a portion of the fixing sleeve 62*c* downstream of the fixing nip in a direction in which the fixing sleeve 62*c* rotates, and accordingly temperature thereof decreases. Then, the excitation coil 110 is activated when the temperature detector 67 detects a decrease in temperature of the sheet area, and thus that portion can be heated to a temperature suitable for fixing again while passing a portion facing the activated excitation coil 110.

Such a decrease in temperature of the fixing roller 62 occurs mainly in the sheet area. Therefore, if the excitation coil 110 is activated according to only the temperature detected by the temperature detector 67, the end portions of the fixing roller 62 can be overheated when the width of the sheet S is smaller than the maximum width, that is, the widths of A3-T or A4 size.

Therefore, in the present embodiment, when the temperature detector 68 detects that the temperature of the end portion is higher than the predetermined temperature, at least one of the switches 122*a*, 122*b*, and 122*c* is selectively turned on, thus reducing heat generation in the end portions so as to prevent excessive temperature rise therein.

When multicolor images are formed in the above-described image forming apparatus 100 shown in FIG. 1, a sequence of predetermined image forming processes is performed after the user presses the print start key on the operation panel 40 shown in FIG. 2.

After the sequence of image forming processes, that is, a current image formation job designated by the user, is completed, the image forming apparatus 100 starts a subsequent image formation job when such a job is designated by the user during the current job. By contrast, when such a subsequent job is not yet designated, the image forming apparatus 100 is in a standby mode until a predetermined or given time period has elapsed or a subsequent image formation job is designated. Then, when the predetermined time period has elapsed without input of a subsequent image formation job after entering the standby mode, the image forming apparatus 100 is in a sleep mode until a subsequent predetermined or given time period has elapsed or a subsequent image formation job is designated. Further, the image forming apparatus 100 is turned off when the predetermined time period has elapsed without input of a subsequent image formation job after entering the sleep mode.

Depending on the above-described operation modes of the image forming apparatus 100, the control circuit 126 of the fixer controller 69 shown in FIG. 5 changes the amount of electricity supplied to the excitation coil 110 within a range from 0 W to 800 W, for example.

More specifically, during the image forming processes, that is, the fixing operation, the sheet S is fed to the fixer 6, and accordingly the fixer 6 is in a fixing mode to heat the fixing roller 62 so as to be able to fix the image on the sheet S. Thus, the electricity supplied to the excitation coil 110 is higher during the image forming processes.

By contrast, the electricity supplied to the excitation coil 110 is lower during the standby mode during which the sheet S is not fed to the fixer 6 although the temperature of the fixing roller 62 should be kept at the temperature suitable for fixing (fixing target temperature). The electricity supplied to the excitation coil 110 is lower also in the temperature equalization mode to reduce temperature unevenness in the fixing roller 62, which is described below. The electricity supplied to the excitation coil 110 is further lower during a time period such as the sleep mode during which the fixing roller 62 is maintained in a state from which the fixing roller 62 can be promptly heated to the temperature suitable for fixing.

Because the image forming apparatus 100 can accommodate various different sheet sizes, differences in temperature in the sheet width direction of the fixing roller 62 can be significant if all the switches 122*a*, 122*b*, and 122*c* are turned on and off integrally not independently.

Therefore, in the present embodiment, the switches 122*a*, 122*b*, and 122*c* can be turned on and off selectively depending on the sheet area.

This localized demagnetization control is described in further detail below with reference to FIG. 7.

The demagnetization effects in the present embodiment are described below in further detail with respect to FIG. 7.

Figure 7:
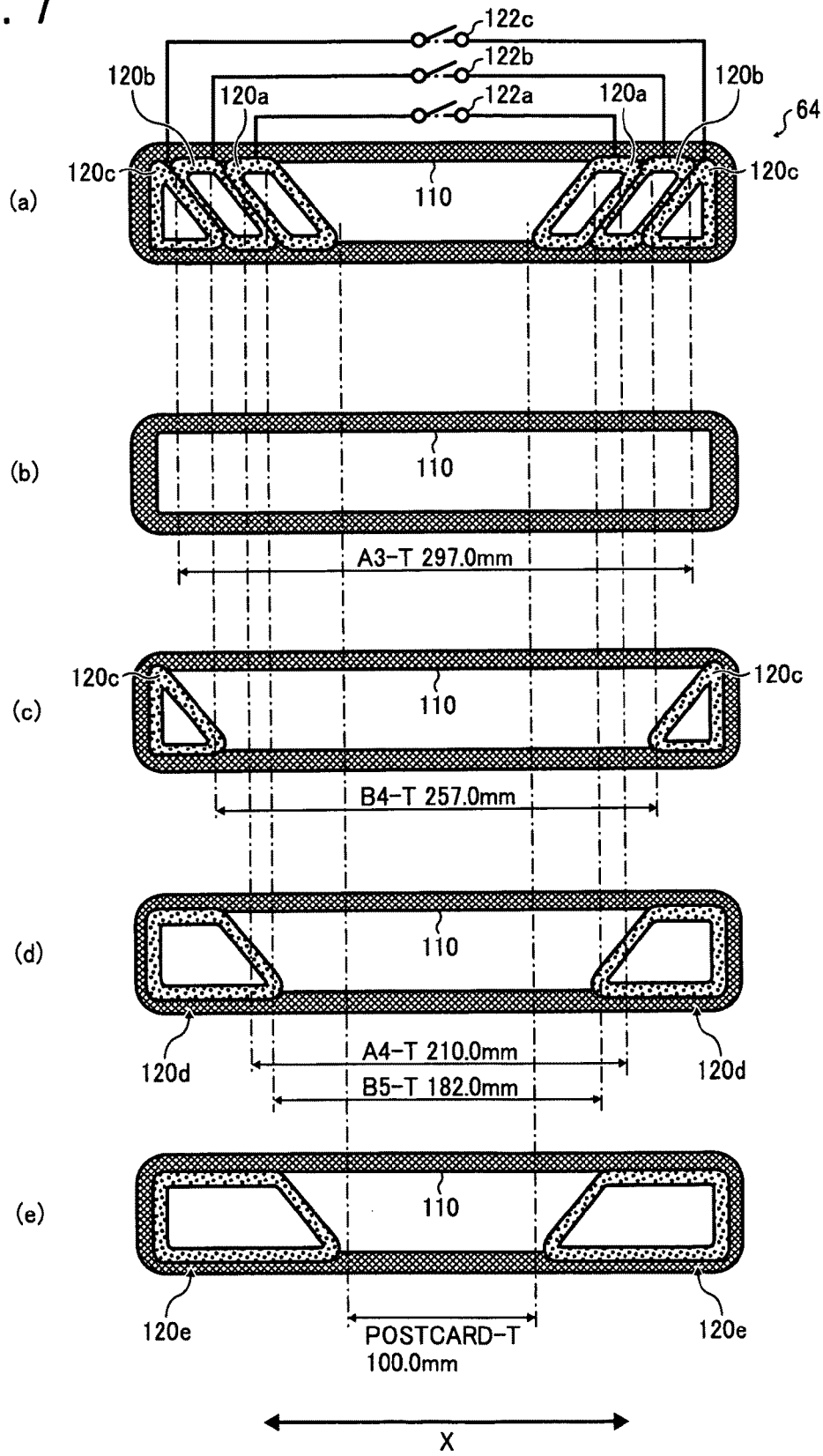
FIG. 7 schematically illustrates demagnetization effects in the fixer shown in FIG. 3 for various sheet sizes.

In FIG. 7, (a) schematically illustrates the induction heating unit 64, and (b) through (e) respectively show demagnetization effects for A3-T size, B4-T size, A4-T size, and B5-T size.

Referring to FIG. 7, when all the switches 122*a* through 122*c* are off (open), the demagnetization effect is similar to a case in which no demagnetization coil is provided as shown in (b), and thus suitable for A3-T size or A4 size.

When only the switch 122*c* is on, energizing only the demagnetization coils 120*c*, demagnetization effect is similar to a case in which only the demagnetization coils 120*c* is provided as shown in (c) and thus suitable for B4-T size.

By contrast, when the two switches 122*b* and 122*c* are on, demagnetization effect is similar to a case in which demagnetization coils 120*d* each having an outline formed by both the demagnetization coils 120*b* and 120*c* are activated as shown in (d) and thus suitable for A4-T size and B5-T size. When all the switches 122*a* though 122*c* are on, demagnetization effect is similar to a case in which demagnetization coils 120*e* each having an outline formed by all the demagnetization coils 120*a*, 120*b*, and 120*c* are activated as shown in (e) and thus suitable for postcard-T size.

The above-described localized demagnetization control is performed by the fixer controller 69 shown in FIG. 5 that serves a localized demagnetization controller. In other words, the fixer controller 69 determines the degree or type of demagnetization operation, or a demagnetization area by selecting the switch or switches (122*a*, 122*b*, and 122*c*) to be closed.

Next, shape and arrangement of the demagnetization coils are described below.

As shown in FIG. 7, each of the demagnetization coils 120*c*, 120*b*, and 120*c* has a side oblique to the sheet width direction X, and the oblique sides of two adjacent demagnetization coils are superimposed one on another. With these features, when two or all of the demagnetization coils 120*c*, 120*b*, and 120*c* are activated together, demagnetization effects can be similar to the cases when the demagnetization coils 120*d* or 120*e* are provided. Thus, a single demagnetization coil can correspond to an increased number of sheet sizes, which is advantageous.

As described above, in the fixer 6 according to the present embodiment, by controlling demagnetization locally, that is, by selectively energizing the demagnetization coils 120*a*, 120*b*, and 120*c*, according to sheet size, excessive heating in the non-sheet area can be better prevented or reduced when various different sizes of sheets S are fixed.

Figure 8:
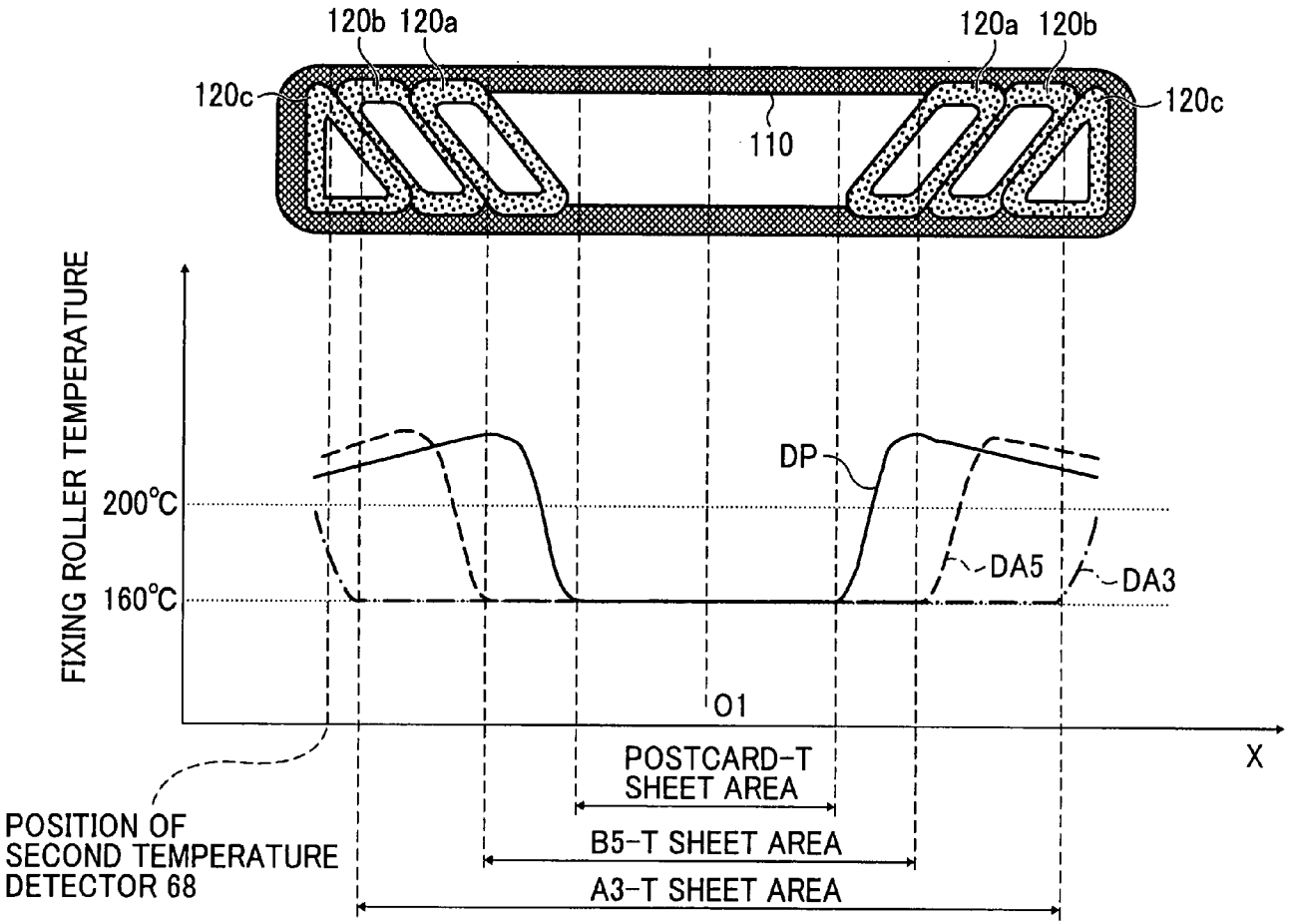
FIG. 8 illustrates differences in temperature of a rotary heat generator of the fixer shown in FIG. 3 in an axial direction thereof.

However, controlling demagnetization locally is not sufficient to equalize the temperature of the fixing roller 62 in the sheet width direction X when sheets smaller than A3-T sheets are continuously fixed in the fixer 6, as shown in FIG. 8.

In the graph shown in a lower portion of FIG. 8, the vertical axis shows temperature of the fixing roller 62, the horizontal axis shows positions in the sheet width direction of the fixing roller 62. Reference characters DP, D5A, and DA3 respectively represent differences in the temperature of the fixing roller 62 when postcards placed lengthwise, B5-T sheets, and A3-T sheets are continuously fixed in the fixer 6, respectively.

As shown in FIG. 8, even when demagnetization is controlled locally, temperature of the non-sheet area is higher than that of the sheet area by from 10° C. to 50° C. when sheets smaller than A3-T sheets are continuously fixed in the fixer 6.

It is to be noted that the temperature of the fixing roller 62 drops at the end portions because heat is lost more easily from the end portions than from other portions such the center portion.

If an image is fixed on a sheet S whose size is larger than the sheet size that has caused the above-described temperature unevenness by the fixing roller 62 whose temperature is thus uneven, the sheet S receives heat unevenly in the sheet width direction X. As a result, the degree of gloss (hereinafter "gloss degree") on the fixed image will differ in the sheet width direction X.

Although the temperature of the fixing roller 62 will become uniform over time if a subsequent job is not to be executed shortly, the present embodiment can reduce the above-described temperature unevenness through a method described below even when a subsequent job is to be executed relatively shortly.

It is to be noted that the image formation job referred to herein includes, but not limited to, copying, printing, outputting data transmitted from a computer or a fax machine, and the like, as long as it includes forming an image on a recording medium and outputting it.

When data of a first image formation job (current job) indicates that the width of sheets S (B4-T or A4T) in the first image formation job is smaller than the maximum width (e.g., A3-T or A4) usable in the fixer 6, the fixer controller 69 shown in FIG. 5 enters the temperature equalization mode to equalize the temperature of the fixing roller 62 during a time period after completion of the first image formation job (hereinafter also simply referred to as "first print job") before start of a second job (subsequent job).

In the temperature equalization mode, the fixer controller 69 controls activation of both the excitation coil 110 and the demagnetization coil units 120 so as to reduce differences in temperature between the center portion and the end portions of the fixing roller 62 in the sheet width direction. More specifically, the controller 69 controls activation of both the excitation coil 110 and the demagnetization coil units 120 so as to lower the temperature of the end portions of the fixing roller 62. Alternatively, activation of these coils can be controlled so as to raise the temperature of the center portion of the fixing roller 62.

The temperature equalization mode can be entered simultaneously with completion of the first print job or immediately after it. Alternatively, temperature equalization mode can be entered continuously with the first print job.

Although, in practice, the temperature equalization mode is entered subsequent to completion of the fixing operation, alternatively, the timing to start temperature equalization can be as follows. At least one of the excitation coil 110 and the demagnetization coil units 120 is turned off, and then both of them are activated, immediately after which the temperature equalization mode can be entered.

The fixer controller 69 further determines when to end the temperature equalization mode.

In the temperature equalization mode, to reduce the differences in temperature, the control circuit 126 shown in FIG. 5 activates both the excitation coil 110 and the demagnetization coil units 120.

More specifically, the control circuit 126 controls activation of the excitation coil 110 by driving a switching element 125 (shown in FIG. 12) of the excitation coil 110 so as to keep the temperature of the center portion (sheet area) of the fixing roller 62 at the first predetermined temperature (target temperature during TEMP-EQ mode) while the sheet S is not fed to the fixer 6 (hereinafter "non-sheet-feeding time").

Further, the control circuit 126 controls activation of the demagnetization coil units 120 so as to restrict heating in the non-sheet area of the fixing roller 62 by selectively closing at least one of the switches 122*a*, 122*b*, and 122*c*, that is, determining a demagnetization area, in a manner similar to that in the first print job.

The first predetermined temperature is one from which the temperature of the fixing roller 62 can be quickly raised to the fixing set temperature when the image forming apparatus receives a subsequent job (second job). More specifically, the first predetermined temperature is not greater than the fixing set temperature, that is, the target temperature during image formation. The fixing set temperature may be within a range from 180° C. to 190° C., for example.

The first predetermined temperature (target temperature during TEMP-EQ mode) can be identical regardless of the width of the sheet and can be, but not limited to, 170° C. as shown in FIG. 9. Alternatively, the first predetermined temperature may be set according to the length of the sheet S in the axial direction (width) of the fixing roller 62 or may be set according to both the width and the size of the sheet S. For example, the first predetermined temperature may be set to one of several optimal values that can be preliminarily obtained through test runs and stored in a table in the controller 90 (shown in FIG. 2) of the image forming apparatus 100.

The activation of the excitation coil 110 is controlled so that the temperature of the center portion of the fixing roller 62 is kept at the first predetermined temperature or approaches the first predetermined temperature. The activation of the demagnetization coil units 120 is controlled so that the amount of heat released (hereinafter "heat release amount") from the end portions (non-sheet area) is greater than the amount of heat generated (hereinafter "heat generation amount") therein.

When the above-described temperature equalization mode is entered, the temperature in the sheet area of the fixing roller 62 is kept at the temperature suitable for fixing or the temperature from which the temperature of the fixing roller 62 can be quickly raised to the fixing set temperature. Simultaneously, in the non-sheet area of the fixing roller 62, because the heat release amount is greater than the heat generation amount during the temperature equalization mode, the temperature thereat decreases to close to the temperature in the sheet area. That is, the temperature in the non-sheet area of the fixing roller 62 decreases relative to the temperature in the sheet area of the fixing roller 62.

FIG. 9 shows a table of examples of parameters used for the temperature equalization mode. The parameters includes a threshold temperature T, the target temperature during TEMP-EQ mode, a rotational velocity during TEMP-EQ mode, demagnetization duty, a sheet number N, a first control time $t_1$, a second control time $t_2$. In the table shown in FIG. 9, "COIL 1", "COIL 2", and "COIL 3" respectively correspond to demagnetization coils 120*a*, 120*b*, and 120*c* shown in FIG. 4.

The threshold temperature T is a predetermined or reference temperature of the non-sheet area, serving as a second predetermined temperature, used to determine whether or not to enter the temperature equalization mode. The rotational velocity during TEMP-EQ mode is a rotational velocity of the fixing roller 62 during the temperature equalization mode. The sheet number N is a predetermined or given number of sheets (hereinafter also "sheet number in continuous fixing") continuously fed to the fixer 6 during the first print job. The demagnetization duty is an open-close ratio (duty ratio) of each of the respective switches 122*a*, 122*b*, and 122*c*. The first control time $t_1$ and the second control time $t_2$ are predetermined or given time periods from the start of the TEMP-EQ mode to the start of the second image formation job.

Referring to FIG. 9, during the temperature equalization mode, feedback control is performed so that the temperature detected by the temperature detector 67 is kept at the target temperature during TEMP-EQ mode, that is, the first predetermined temperature, (e.g., 170° C.). Activation of the excitation coil 110 and the demagnetization coil units 120 is controlled through PID (proportional-integral-differential) control.

When activation of the excitation coil 110 is controlled so as to keep the temperature detected by the temperature detector 67 (measurement value) at the target temperature during TEMP-EQ mode (170° C.), the heat generation amount is balanced by the heat release amount in the center portion (sheet area) of the fixing roller 62 in the sheet width direction. Simultaneously, in the end portion (non-sheet area) of the fixing roller 62 in the sheet width direction, temperature decreases because the heat release amount is greater than the heat generation amount therein as described above. Thus, the temperature of the fixing roller 62 can be equalized at the target temperature during TEMP-EQ mode (170° C.) across the entire in the sheet width direction thereof.

In other words, activation of the excitation coil 110 is controlled based on the measurement value by the temperature detector 67 so as to bring the temperature in the center portion close to the first predetermined temperature.

This control method is described in further detail below using distribution models of a calorific value per second given to the fixing roller 62 with reference to FIGS. 10A and 10B that respectively illustrate two different states of the fixing roller 62 (1) that during the temperature equalization mode without feeding of sheets and (2) that during the fixing operation in which the sheet S whose width is smaller than the maximum sheet width is fed to the fixer 6.

Figure 10A:
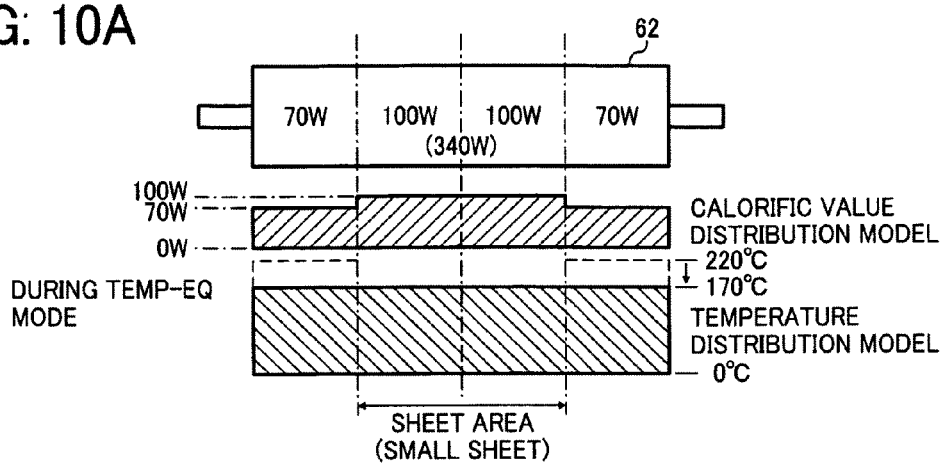
FIG. 10A illustrates the relation between distribution of calorific value given to the rotary heat generator and temperature distribution therein in the temperature equalization mode.
Figure 10B:
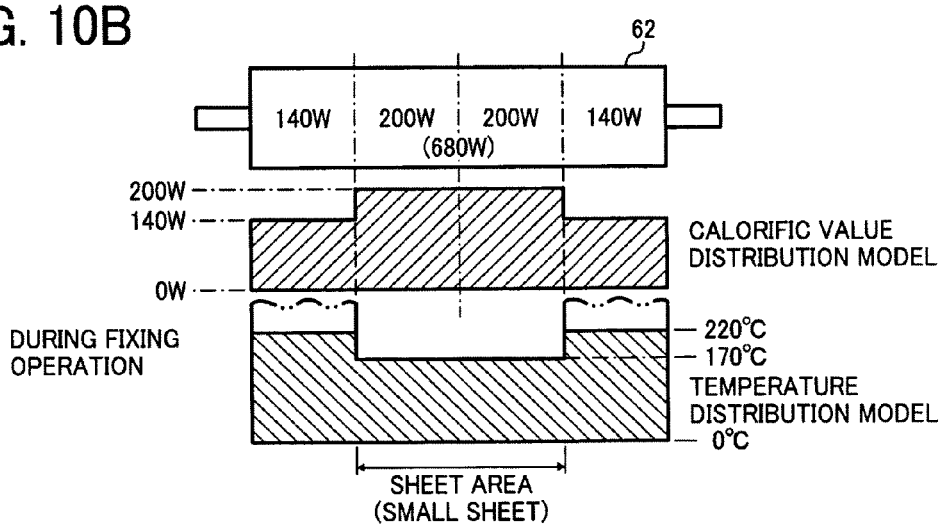
FIG. 10B illustrates the relation between distribution of calorific value given to the rotary heat generator and temperature distribution therein when smaller sheets are fed to the fixer.

In each of FIGS. 10A and 10B, an upper portion is the fixing roller 62 that is divided into four areas, right and left sheet areas and right and left non-sheet areas, a middle portion is the distribution model of calorific value given to the fixing roller 62, and a lower portion is a temperature distribution model.

As shown in FIG. 10B, during the fixing operation, for example, a calorific value of 200 W is given to each sheet area and a calorific value of 140 W is given to each non-sheet area. Thus, the fixing roller 62 receives a calorific value of 680 W in total.

As shown in the temperature distribution model in FIG. 10B, the temperature is kept at 170° C. in the sheet areas. In the non-sheet areas, the temperature can be held to 220° C., for example, although the temperature can further increase as indicated by double-dashed lines when the demagnetization coil units 120 are not activated.

As shown in FIG. 10A, an amount of electricity given to the excitation coil 110 is lower than that in the fixing operation because the temperature equalization mode according to the present embodiment is entered after the fixing operation is completed, that is, during the non-sheet-feeding time. In other words, the amount of electricity supplied to the excitation coil 110 is such that the target temperature during TEMP-EQ mode (first predetermined temperature) can be maintained even when heat is not drawn off by the sheet S. The amount of demagnetization flux generated by the demagnetization coil units 120 varies according to the amount of electricity supplied to the excitation coil 110.

More specifically, during the temperature equalization mode, for example, a calorific value of 100 W and a calorific value of 70 W are respectively given to each sheet area and each non-sheet area as shown in FIG. 10A. Thus, the fixing roller 62 receives a calorific value of 340 W in total, which is half the calorific value during the fixing operation in the example shown in FIGS. 10A and 10B. At this time, in a non-sheet area of the fixing roller 62 on which the demagnetization coil unit 120 acts, the heat generation amount is lower than the heat release amount, and thus the temperature in the non-sheet area can decrease quickly from 220° C. to 170° C., that is, the temperature of the fixing roller is equalized in the sheet width direction (axial direction of the fixing roller).

In the temperature equalization mode according to the present embodiment, because the electricity supply amount to the excitation coil 110 is set to an amount for the non-sheet-feeding time as described above, energy consumption is not unnecessarily large. Needless to say, the electricity supply amount to the excitation coil 110 in the temperature equalization mode can be set to an amount higher than that for the non-sheet-feeding time.

Figure 11:
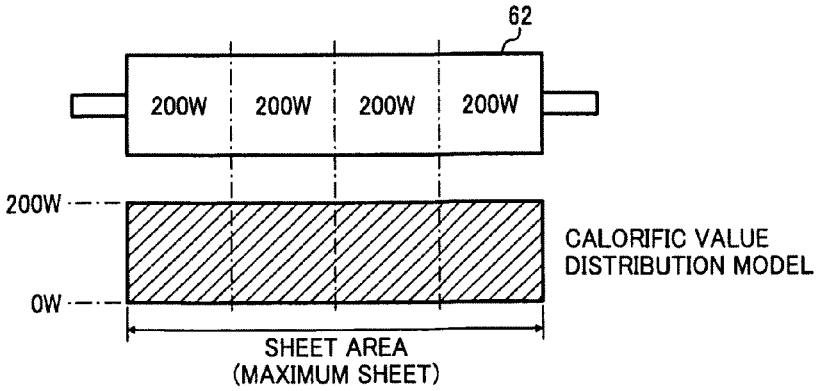
FIG. 11 illustrates distribution of calorific value given to the rotary heat generator when maximum sheets are fed to the fixer.

It is to be noted that, as shown in FIG. 11, when the sheet S is the maximum sheet, which does not cause the temperature difference of the fixing roller 62, the calorific value given to the fixing roller 62 can be the same or similar in the respective areas thereof.

Figure 12:
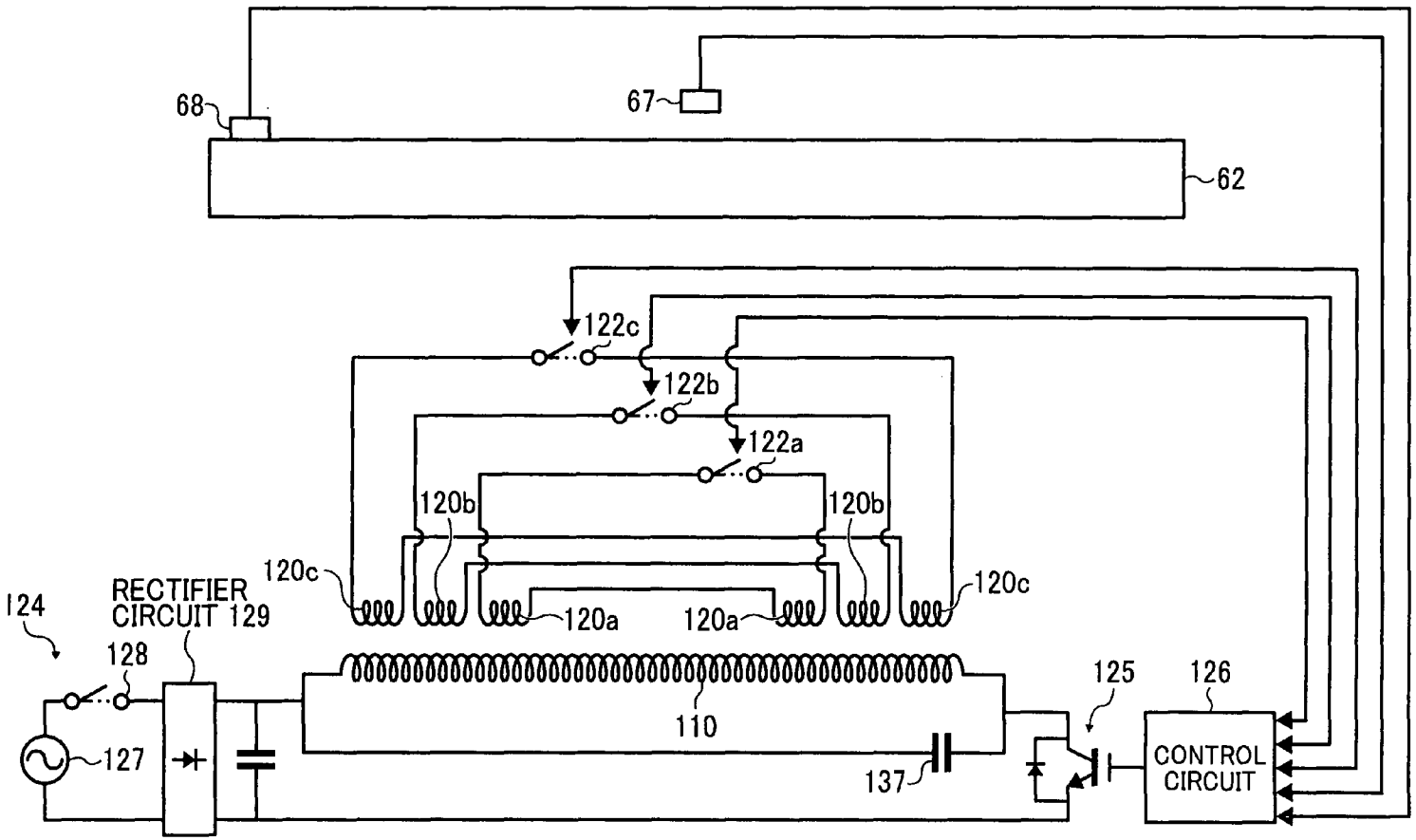
FIG. 12 illustrates relative positions of the excitation coil, the demagnetization coil units, and temperature detection in the axial direction of the rotary heat generator.

FIG. 12 schematically illustrates a power supply unit 124 for the excitation coil 110, and relative positions of the excitation coil 110, the demagnetization coils 120*a*, 120*b*, and 120*c*, and the first and second temperature detectors 67 and 68.

Referring to FIG. 12, the power supply unit 124 includes the switching element 125, the control circuit 126, the commercial power source 127, a power source switch 128, a rectifier circuit 129, and a resonant capacitor 137. In the present embodiment, the power supply unit 124 supplies a high-frequency alternating current (AC) of within a range from 10 kHz to 1 MHz, preferably within a range from 20 kHz to 800 kHz, to the excitation coil 110 to generate magnetic flux in an area close to the fixing roller 62.

Electricity supply (activation) to the excitation coil 110 is controlled through pulse-width modulation (PWM) of the switching element 125. Thus, the temperature of the fixing roller 62 can be quickly set to or be brought close to the first predetermined temperature, that is, the response speed can be faster.

The rotational velocity of the fixing roller 62 is described below.

In the present embodiment, the fixing roller 62 is rotated during the temperature equalization mode. The rotational velocity during TEMP-EQ mode is lower than that during the fixing operation (first image formation job) and higher than that during a warm-up operation. If the rotational velocity during TEMP-EQ mode is higher than that in the fixing operation, the temperature of the fixing roller 62 might not be equalized. If the rotational velocity during TEMP-EQ mode is lower than that in the warm-up operation, the heat release amount is smaller in end portions of the fixing roller 62, and accordingly temperature cannot decrease quickly therein.

Because rotating the fixing roller 62 can facilitate heat release and thus lower the temperature, it is preferable that the rotational velocity during TEMP-EQ mode be higher within the range described above.

Referring to FIG. 9, the fixing roller 62 is kept rotating at a rotational velocity of is 230 mm/s (rotational velocity during TEMP-EQ mode), for example, and thus its temperature is equalized in the circumferential direction as well as in the axial direction. Because temperature decrease rate is higher in a high-temperature area than in a low-temperature area, the temperature in the non-sheet areas of the fixing roller 62 decreases relative to that of the sheet area thereof. This temperature decrease is facilitated by entering the temperature equalization mode, reducing the differences in temperature quickly. Thus, productivity of the image forming apparatus 100 shown in FIG. 1 can be improved.

The parameters shown in FIG. 9 are described in further detail below.

In the present embodiment, the temperature equalization mode can be entered when at least one of following two conditions is satisfied: A first condition is that the temperature of the end portion of the fixing roller 62 detected by the temperature detector 68 shown in FIG. 12 exceeds the threshold temperature T (second predetermined temperature) not lower than the first predetermined temperature. A second condition is that the number of sheets continuously fed to the fixer 6 during the first print job exceeds the sheet number N that in the example shown in FIG. 9 is 10.

The first condition is described below in further detail.

The threshold temperature T is a temperature suitable for determining that the temperature of the fixing roller 62 is not uniform when the temperature detected by the second detector 68, which is disposed at a position that is always the non-sheet area, exceeds the threshold temperature T. When this first condition is satisfied, such temperature unevenness is predicted to cause image failure such as unevenness in gloss level and hot-offset in fixed images.

It is to be noted that, although unevenness in gloss level can be within a tolerable range when the temperature detected by the temperature detector 68 is not higher than 200° C., when the width of the sheet S is equal to or greater than A3-T size, and accordingly the temperature equalization mode is not entered, temperature drops in the end portion of the fixing roller 62 as shown in FIG. 8. Therefore, the threshold temperature T is lower than 200° C. in the example shown in FIG. 9.

Additionally, because the degree of temperature unevenness, that is, the temperature detected by the temperature detector 68 depends on the length of the sheets in the axial direction of the fixing roller 62 or the size of the sheets S as shown in FIG. 8, the threshold temperature T (second predetermined temperature) is set according to the width or the size of the sheets S used in the first print job as shown in FIG. 9.

The threshold temperature T is set by the fixer controller 69 shown in FIG. 2, and thus the fixer controller 69 serves as a second predetermined temperature setter.

As to the second condition, it is known that temperature unevenness corresponding to rotation cycles of the fixing roller 62, called temperature ripples, can occur while the sheets S are fed to the fixer 6. When temperature ripples occur, the temperature as detected by the temperature detector 68 at the end of the fixing operation might exceed the threshold temperature T accidentally, satisfying the first condition. This is a case in which an area whose temperature is higher because of temperature ripples faces the temperature detector 68 at the end of the fixing operation, and accordingly the temperature detector 68 detects the temperature of that area. Even when the first condition is satisfied, it is predicted that the temperature unevenness is within a tolerable range as long as the number of sheets S fed to the fixer 6 is relatively small.

Therefore, alternatively, the temperature equalization mode can be entered when both the first condition is satisfied and the number of sheets S continuously fed to the fixer 6 in the first print job exceeds the predetermined sheet number N (e.g., 10).

The relation between the first condition and the second condition, that is, the relation between the threshold temperature T and the sheet number N, is set so that the temperature detected by the temperature detector 68 reaches the threshold temperature T when an image is fixed on a Nth sheet S in the current job under a standard temperature and humidity condition.

More specifically, for example, in the example shown in FIG. 9, when ten A4-T sheets are continuously fed to the fixer 6 from the standby mode, the temperature detected by the temperature detector 68 is 180° C. Because the temperature in the non-sheet areas detected by the temperature detector 68 can be thus predicted based on the number of sheets continuously fed to the fixer 6, another type of temperature detector that can predict the temperature of the non-sheet area can be used instead of the temperature detector 68. Such a temperature detector can be configured using the fixer controller 69.

During the temperature equalization mode entered after the first print job, when the temperature in the end portions (non-sheet area) of the fixing roller 62 decreases to the second predetermined temperature, the fixer controller 69 stops supplying electricity to both the excitation coil 110 and the demagnetization coil units 120.

In other words, from the decrease in temperature in the end portions of the fixing roller 62 detected by the temperature detector 68, such temperature unevenness can be deemed to be within such an extent that unevenness in gloss level is within a tolerable range.

However, when the image forming apparatus 100 is to enter the standby mode after the temperature equalization mode is exited, activation of only the demagnetization coil units 120 is stopped, maintaining activation of the excitation coil 110 so as to keep the temperature of the fixing roller 62 at a temperature suitable for the standby mode with the temperature unevenness reduced.

The demagnetization duty is described below.

In the temperature equalization mode, as described above, the fixer controller 68 serving as a demagnetization controller restricts heat generation in the non-sheet areas of the fixing roller 62 by determining the demagnetization area according to the width of the sheets S.

Further, the fixer controller 69 determines the ratio of close time to open time per unit time of the switch or switches (122*a*, 122*b*, and 122*c*) to be closed. That is, the fixer controller 69 also controls open-close ratio (duty ratio) of the switches 122*a*, 122*b*, and 122*c* so as to adjust a degree of demagnetization of the magnetic flux. Thus, the fixer controller 69 determines the degree of demagnetization. It is to be noted that unit time of the demagnetization duty means a control cycle of the fixer controller, which can be flexibly set depending on operational conditions, environmental conditions, and the like.

It is to be noted that hereinafter determining demagnetization operation includes both selecting the switch or switches to be closed and selecting the demagnetization duty thereof.

During the temperature equalization mode entered after the first print job, the switch or switches (122*a*, 122*b*, and 122*c*) of the demagnetization coil units 120 are driven at a duty ratio identical or similar to that in the first print job. It is to be noted that the demagnetization duty ratio in the TEMP-EQ mode is not necessarily identical to that in the first print job and can be flexibly set.

Alternatively, a variable resistor can be provided for each of the switches 122*a*, 122*b*, and 122*c* for controlling the demagnetization duty, and a resistance value thereof can be adjusted instead of or together with open-close ratio of the switches 122*a*, 122*b*, and 122*c*.

When a subsequent job (second job) is received during the temperature equalization mode, the fixer controller 69 starts the second job after a predetermined or given time period has elapsed from the start of the temperature equalization mode. The predetermined time period is the first control time $t_1$ when the second image formation job is a copy job and the second control time $t_2$ when the second image formation job is a print job other than copying. As shown in FIG. 9, the first control time $t_1$ (e.g., 5 seconds) is shorter than the second control time $t_2$ (e.g., 15 seconds) in the present embodiment because, when the user requests a copy job, the user generally waits near the image forming apparatus 100 and is accordingly sensitive about the waiting time. The user tends to feel that the waiting time is longer than the actual waiting time. When the number of sheets continuously fed to the fixer 6 in the first print job is not greater than 100, the temperature unevenness is generally deemed to be resolved in about 15 seconds, and thus the second control time $t_2$ is set to 15 seconds in the present embodiment. Thus, satisfactory image quality without unevenness in gloss level can be attained.

It is to be noted that "print job other than copying" means outputting image data that is preliminarily formed, stored in a computer connected to the image forming apparatus 100, and is sent therefrom to the image forming apparatus 100, outputting facsimile data received via a network as a print job when the image forming apparatus 100 serving as a facsimile machine, and the like.

Alternatively, when the user requests a subsequent print job (second print job) during the temperature equalization mode, the second print job can override the active temperature equalization mode because, if the temperature equalization mode is continued in such a case, the user has to wait, that is, productivity and usability of the image forming apparatus 100 are affected.

After the temperature equalization mode is initiated, when the temperature detector 68 detects that the temperature of the end portion of the fixer 62 is not greater than the second predetermined temperature, the temperature equalization mode is excited. Then, the image forming apparatus 100 can enter the standby mode, the sleep mode, or the fixing mode when a subsequent print job has been requested, or can be turned off.

When no subsequent print jobs are requested, the demagnetization coil units 120 can be deactivated after a predetermined or given time period has elapsed from the start of the temperature equalization mode. This time period can be determined through test runs to be an expected time period for the temperature unevenness to be reduced to an extent that unevenness in gloss level is not significant.

By controlling the image forming apparatus 100 as described above, substandard images with uneven gloss level can be prevented or reduced, and hot offset can be better prevented or reduced. Further, although the fixing roller 62 can be degraded or even damaged if the fixing roller 62 is overheated, for example to about 240° C., such damage to the fixing roller 62 can be better prevented or reduced.

A sequence of operations relating to the temperature equalization mode is described below with reference to flowcharts shown in FIGS. 9, 13 and 14.

Figure 13:
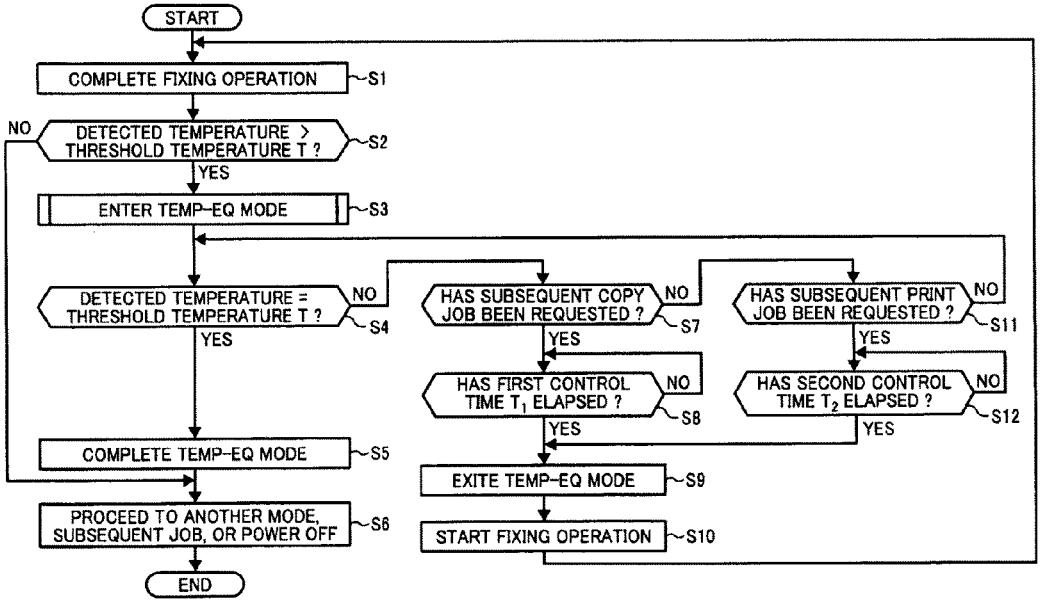
FIG. 13 is a flowchart of operations of the fixer shown in FIG. 3 when the temperature equalization mode is entered.

In the flowchart shown in FIG. 13, it is assumed that smaller sheets such as A4-T sheets or postcards are used in the first print job and that the second condition (sheet number N) for determining execution of the temperature equalization mode is either satisfied or not to be checked. In the flowchart shown in FIG. 14, the demagnetization operation means activation of the demagnetization coil units 120.

Referring to FIGS. 9 and 13, when the fixing operation of the first print job is completed at S1, at S2 the fixer controller 69 checks whether or not the temperature detected by the temperature detector 68 is higher than the threshold temperature T, that is, whether or not the first condition is satisfied.

When the detected temperature is not higher than the threshold temperature T (NO at S2), the fixer controller 69 does not enter the temperature equalization mode, and at S6 the image forming apparatus 100 enters another mode (e.g., standby mode, sleep mode, or fixing mode to start the subsequent print job) or is turned off.

By contrast, when the detected temperature is higher than the threshold temperature T (YES at S2), at S3 the fixer controller 69 starts the temperature equalization mode.

Figure 14:
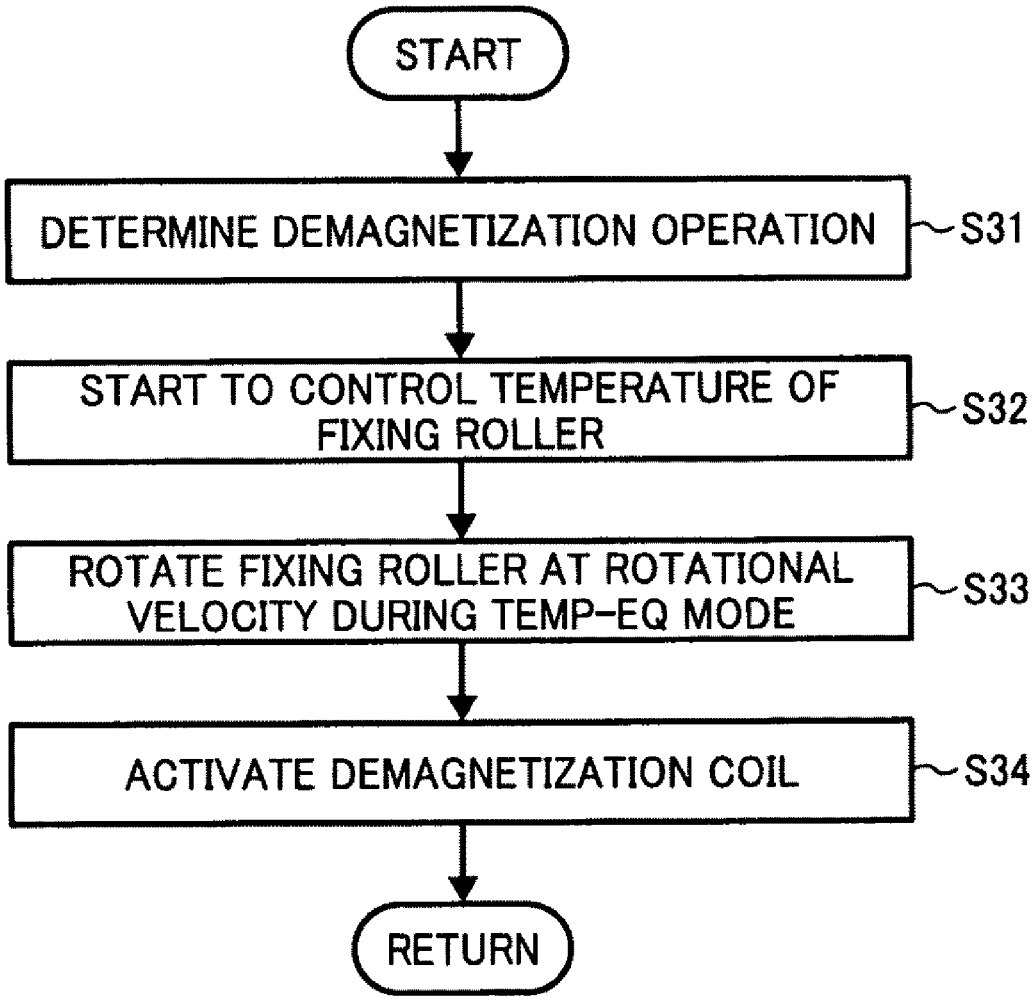
FIG. 14 is a flowchart of operations performed in the temperature equalization mode.

More specifically, referring to FIG. 14, at S31 the fixer controller 69 determines the demagnetization operation according to the width of the sheets in the first print job that is most recently executed (last print job). The fixer controller 69 serves as a demagnetization type storage unit that stores reference data for deciding which switch or switches (122*a*, 122*b*, and 122*c*) are to be closed and the demagnetization duties thereof corresponding to the width of the sheets in the first print job, and the operation of S31 includes retrieving the reference data from the fixer controller 69.

At S32, the fixer controller 69 starts to keep the temperature of the fixing roller 62 at the target temperature during TEMP-EQ mode. More specifically, at S33 the fixer controller 69 rotates the fixing roller 69 at the rotational velocity during TEMP-EQ mode and at S34 starts the demagnetization operation determined at S31. Thus, the fixing controller 69 selectively close at least one of the switches 122*a*, 122*b*, and 122*c* at the demagnetization duty set at S31.

In the present embodiment, when the first condition is satisfied, the temperature equalization mode is initiated immediately after completion of the fixing operation in the first print job, promptly reducing the temperature unevenness. Alternatively, the temperature equalization mode can be started after a predetermined or given time period (e.g., 1 second) has elapsed after the fixing operation is completed, allowing the temperature unevenness to reduce due to natural heat release. In this case, whether or not to wait for such a predetermined time period for natural heat release can be determined depending on the temperature detected by the temperature detector 68. For example, such a predetermined time period can be set only when the detected temperature is not higher than a predetermined or given temperature.

Referring to FIG. 13, after the temperature equalization mode is thus initiated at S3, at S4 the temperature of the non-sheet area of the fixing roller 62 is monitored by the temperature detector 68. The fixer controller 68 checks whether or not the detected temperature has decreased to the threshold temperature T. When the detected temperature is identical or similar to the threshold temperature T (YES at S4), at S5 the temperature equalization mode is completed. That is, the demagnetization coil units 120 are deactivated, and the process proceeds to S6.

By contrast, when the detected temperature has not yet decreased to the threshold temperature T (NO at S4), at S7 the fixer controller 69 checks whether or not a subsequent copy job has been requested. When such a subsequent copy job has been requested (YES at S7), at S8 the fixer controller 69 checks whether or not the first control time $t_1$ has elapsed. After the first control time $t_1$ has elapsed (YES at S8), at S9 the temperature equalization mode is excited, and then at S10 the fixing operation for the subsequent job is started.

When there are no subsequent copy jobs (NO at S7), at S11 the fixer controller 69 checks whether or not a subsequent print job other than copying has been requested. When the subsequent print job other than copying has been requested (YES at S11), at S12 the fixer controller 69 waits until the second control time $t_2$ has elapsed, and at S9 the temperature equalization mode is terminated. At S10 the fixing operation for the subsequent print job is started.

By contrast, when there is no subsequent print jobs (NO at S11), the process returns to S4.

Figure 15:
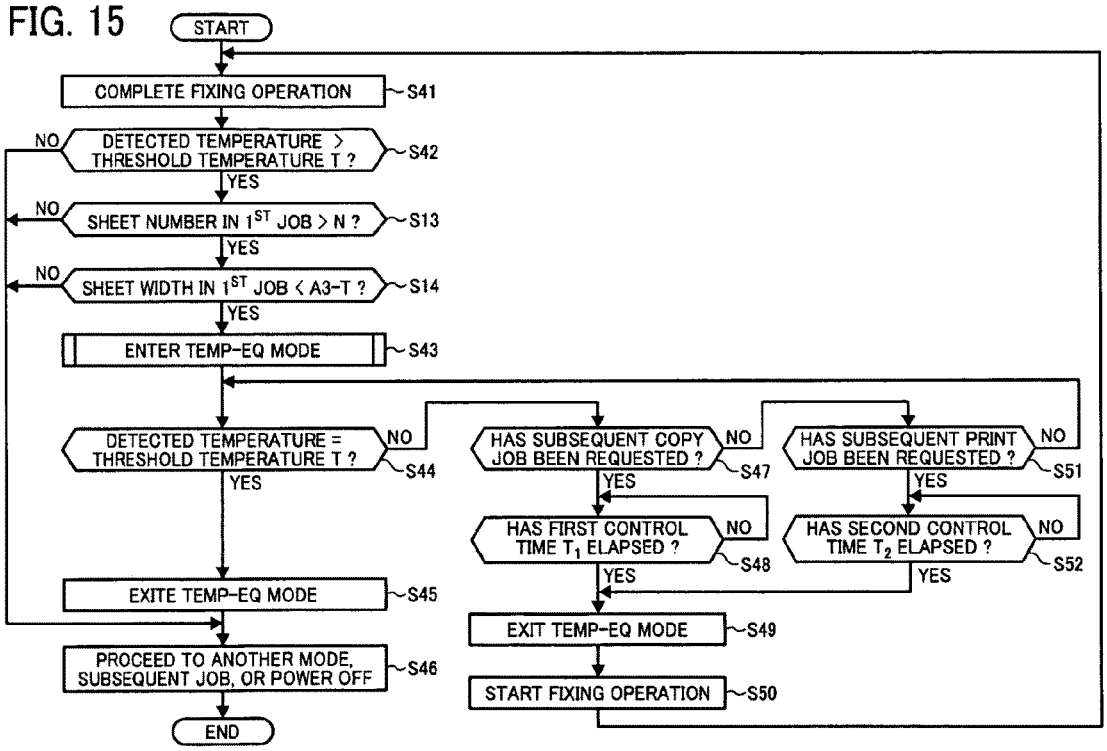
FIG. 15 is another flowchart of operations of the fixer shown in FIG. 3 when the temperature equalization mode is entered.

FIG. 15 illustrates another flowchart of the temperature equalization mode, in which the second condition (sheet number N) and a third condition that the width of sheets in the first print job is smaller than that of A3-T sheets as well as the first condition are checked when determining whether or not to enter the temperature equalization mode.

In FIG. 15, operations performed at S41 through S52 are similar to those performed at S1 though S12 shown in FIG. 13, and thus descriptions thereof are omitted or simplified.

Referring to FIG. 15, after the first print job, when the temperature detected by the temperature detector 68 is higher than the threshold temperature T (YES at S42), at S13 the fixer controller 69 checks whether or not the second condition is satisfied, that is, the number of sheets continuously fed to the fixer 6 during the first print job exceeds the sheet number N.

When the number of sheets in the first print job exceeds the sheet number N (YES at S13), at S14 the fixer controller 68 checks whether or not the width of sheets in the first print job is smaller than that of A3-T sheets. When the width of sheets is smaller than that of A3-T sheets (YES at S14), it is deemed that the temperature of the fixing roller 62 is uneven in the sheet width direction, and at S43 the temperature equalization mode is initiated.

By contrast, when the number of sheets in the first print job is not greater than the sheet number N (NO at S13) or when the width of sheets in the first print job is not smaller than that of A3-T sheets (NO at S14), the temperature equalization mode is not entered.

It is to be noted that the present invention is not limited to the above-described illustrative embodiment, and variations are possible.

For example, alignment of the sheets S in the image forming apparatus 100 is not limited to center alignment and can be edge alignment. Alternatively, both center alignment and edge alignment can be used. Position, size, shape, and the number of the demagnetization coils may be determined depending on the alignment of the sheets S in the image forming apparatus 100.

Figure 16:
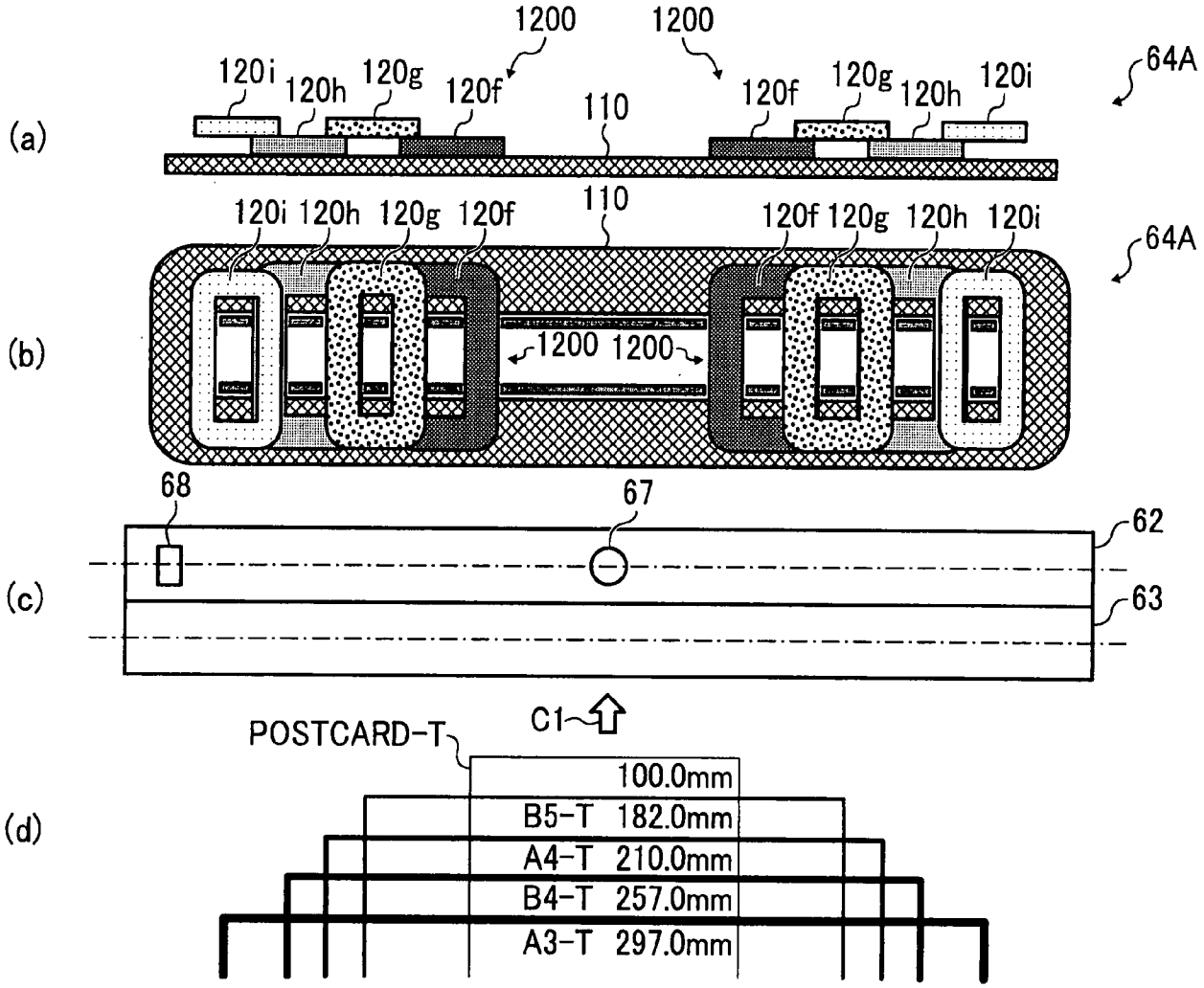
FIG. 16 illustrates a configuration of demagnetization coil units according to another illustrative embodiment.

FIG. 16 illustrates a variation of the demagnetization coils. It is to be noted that other than the demagnetization coils, a configuration of an induction heating unit 64A shown in FIG. 16 is similar to that of the induction heating unit 64 shown in 4, and thus a description thereof is omitted.

As shown in FIG. 16, the induction heating unit 64A includes demagnetization coil units 1200 each including four demagnetization coils 120*f*, 120*g*, 120*h*, and 120*i* that are rectangular and do not include oblique sides. By increasing the number of demagnetization coils, the size of each demagnetization coil can be reduced. Thus, the position, size, shape, and number of the demagnetization coils can be determined flexibly.

When edge alignment, that is, one-side alignment, is adopted, demagnetization coils and a second temperature detector are provided in a second edge portion of the fixer 6 in the sheet width direction that is opposite a first edge portion thereof where even smaller sheets pass, because the second edge portion where smaller sheets do not pass will be overheated. When both center alignment and edge alignment are used, the demagnetization coils must be provided so as to extend across the entire fixing roller in the sheet width direction.

When the sheet area in the second job is smaller than that in the first image formation job, gloss level can be relatively uniform in the second job although the temperature of the fixing roller 62 can be uneven to a certain extent in the sheet width direction. Therefore, in this case, the temperature equalization mode can be omitted or stopped as described below with reference to FIG. 13.

When the user requests a subsequent job (second job) during the temperature equalization mode (YES at S7 and S8), the fixer controller 69 can compare the size of the sheet area in the first image formation job with that in the second job. When the sheet area in the second job is smaller than that in the first image formation job, the temperature equalization mode can be excited to proceed to the second job.

Alternatively, when the user requests the second job, the fixer controller 69 can check whether or not the size of the sheet area in the second job is larger than that in the first image formation job as a fourth condition for determining whether or not to enter the temperature equalization mode. When the fourth condition is satisfied, the fixer controller 69 enters the temperature equalization mode. When the fourth condition is not satisfied, the fixing operation of the second job can be included in the fixing operation of the first image formation job. Thus, the fixer controller 69 can serve as a sheet area comparator.

Next, descriptions will be made below of other examples of the fixer with reference to FIGS. 17, 18, and 19. It is to be noted that, in FIGS. 17, 18, and 19, components that are identical or similar to those of the fixer 6 shown in FIG. 3 are given identical or similar reference characters, and thus descriptions thereof are omitted.

The rotary heat generator can be the fixing roller or the fixing sleeve as in the above-described embodiment shown in FIG. 3. Alternatively, the rotary heat generator can be a fixing belt that generates heat, a heating roller that heats a fixing belt wound around it. Additionally, although the pressure roller 63 presses against the fixing roller 62 directly in the example shown in FIG. 3, alternatively, the pressure roller 63 can presses against the fixing roller 62 indirectly via a fixing belt and the like.

Figure 17:
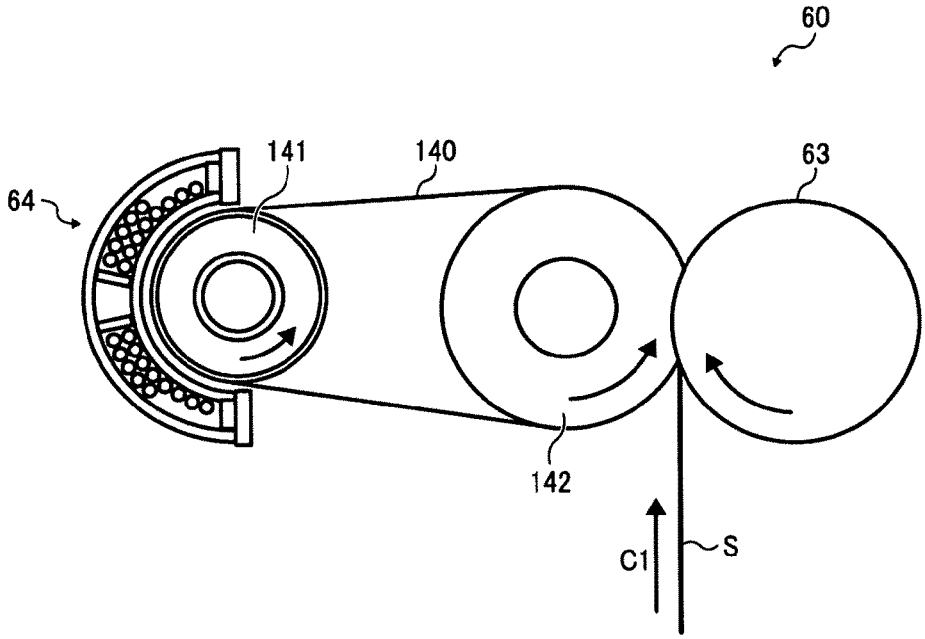
FIG. 17 illustrates a configuration of a fixer according to another illustrative embodiment.

For example, FIG. 17 illustrates a fixer 60 that includes a fixing heat generation belt 140 as a rotary heat generator. The fixing heat generation belt 140 includes a heat generation layer that generates heat induced by an induction heating unit 64. The fixing heat generation belt 140 is looped around a support roller 141 and a roller 142 serving as a rotary fixing member and is rotated by rotation of these rollers.

Figure 18:
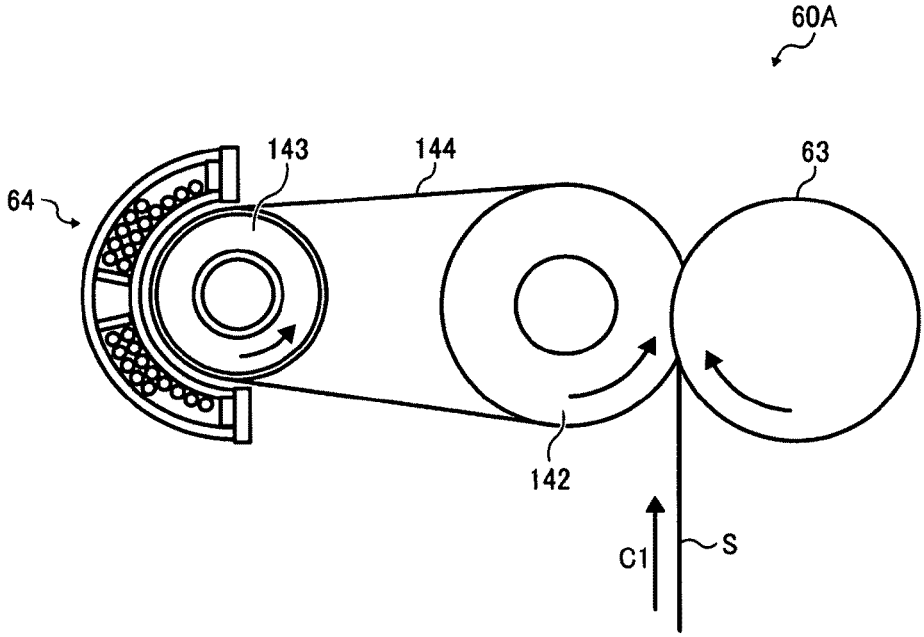
FIG. 18 illustrates a configuration of a fixer according to another illustrative embodiment.

FIG. 18 illustrates a fixer 60A in which a rotary heat generator is formed by a roller 142, a heating roller 143 including a heat generation layer, and a fixing belt 144 looped around the roller 142 and the heating roller 143. Heat generated by the heating roller 143, being inductively heated by the induction heating unit 64, is transmitted to a sheet S via the fixing belt 144.

Figure 19:
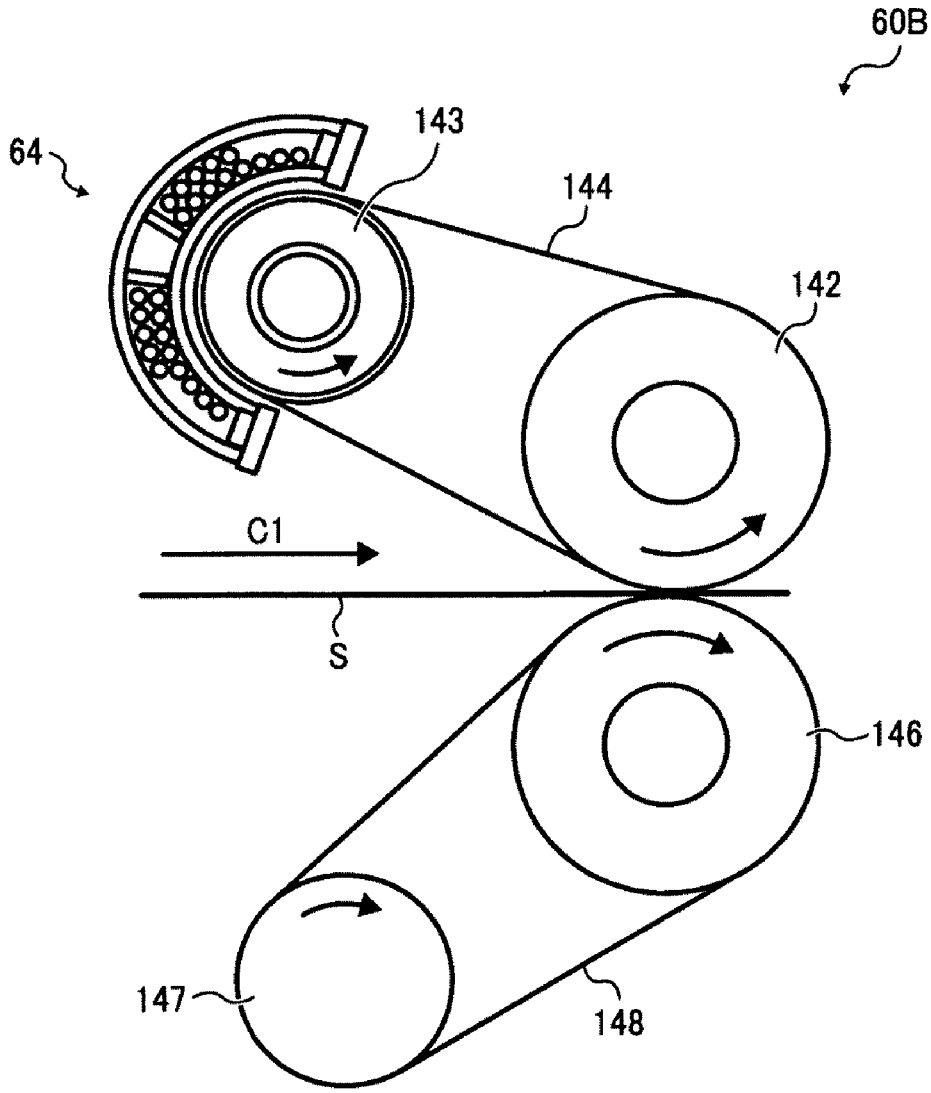
FIG. 19 illustrates configurations of a fixer according to another illustrative embodiment.

FIG. 19 illustrates a fixer 60B that is a variation of the fixer 60A shown in FIG. 18, and a configuration of a pressure rotary member is different from that shown in FIG. 18. That is, instead of the pressure roller 63 shown in FIG. 18, the fixer 60B includes a pressure belt 148 looped around a support and pressure roller 146 and a support roller 147.

Regarding demagnetization, instead of generating the demagnetization flux through secondary induction, alternatively, the fixer further includes a power supply unit dedicated to the demagnetization coil unit so as to generate the demagnetization flux through primary induction. However, in this case, a sum of the magnetic flux output from the excitation coil and that output from the demagnetization coil unit should not be greater than the amount of excitation flux output from the excitation coil that is not counteracted by the demagnetization coil unit.

The power supply for the excitation coil is not limited to AC current but can be direct current (DC). The magnetic flux can be generated by opening and closing a circuit. In this case, also a power supply unit dedicated to the demagnetization coil unit can be used. When such a dedicated power source is not used, the magnetic flux can be generated by opening and closing the demagnetization coil at proper timing.

Additionally, when the demagnetization coils are disposed in the center alignment, two demagnetization coils disposed symmetrically on each side of an axis of symmetry can be opened or closed independently. The excitation coil and the demagnetization coils can be provided inside the rotary heat generator. The fixer controller 69 can be incorporated in the controller 90 of the image forming apparatus 100.

It is to be noted that, although the description above concerns a tandem type multicolor image forming apparatus employing an intermediate transfer method, the fixers according various embodiments of the present invention can be adopted to a monochrome image forming apparatus, a direct-transfer image forming apparatus, and a one-drum type image forming apparatus.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus, comprising:

an image carrier on which an electrostatic latent image is formed;

a developing unit disposed facing the image carrier to develop the latent image with developer;

a transfer unit to transfer the developed image onto a sheet of recording media; and a fixer to fix the image on the sheet, the fixer including:

a rotary heat generator including a heat generation layer;

a pressure member to form a nip with the rotary heat generator to sandwich the sheet therebetween;

an excitation coil disposed facing the rotary heat generator, to inductively heat the heat generation layer;

a demagnetization coil disposed facing the heat generation layer, to generate magnetic flux that partly counteracts magnetic flux generated by the excitation coil; and a fixer controller to control activation of the excitation coil as well as the demagnetization coil before a second image formation job following a first image formation job in which an image is formed on a sheet of recording media whose width is smaller than a maximum sheet width usable in the fixer.

2. The image forming apparatus according to claim 1, wherein, after the first image formation job is completed, the fixer controller reduces a difference between temperature of a center portion and an end portion of the rotary heat generator in an axial direction thereof by controlling the activation of the excitation coil as well as the demagnetization coil.

3. The image forming apparatus according to claim 2, further comprising a first temperature detector to detect a temperature of a center portion of the rotary heat generator, wherein, after the first image formation job is completed, the fixer controller keeps the temperature of the center portion of the rotary heat generator at a first predetermined temperature by controlling the activation of the excitation coil as well as the demagnetization coil.

4. The image forming apparatus according to claim 3, wherein the first predetermined temperature is not greater than a fixing set temperature in the first image formation job.

5. The image forming apparatus according to claim 3, wherein the first predetermined temperature is set according to a length of the sheet in the axial direction of the rotary heat generator in the first image formation job.

6. The image forming apparatus according to claim 3, further comprising a second temperature detector to detect a temperature of the end portion of the rotary heat generator, wherein, after the first image formation job is completed, the fixer controller controls the activation of the excitation coil as well as the demagnetization coil when the temperature of the end portion detected by the second temperature detector exceeds a second predetermined temperature.

7. The image forming apparatus according to claim 6, wherein, while the fixer controller controls the activation of the excitation coil as well as the demagnetization coil, the fixer controller stops the activation of the demagnetization coil when the temperature of the end portion detected by the second temperature detector has decreased to a second predetermined temperature.

8. The image forming apparatus according to claim 6, wherein the second predetermined temperature is not greater than the first predetermined temperature.

9. The image forming apparatus according to claim 6, wherein the second predetermined temperature is set according to a length of the sheet in the axial direction of the rotary heat generator in the first image formation job.

10. The image forming apparatus according to claim 2, further comprising a first temperature detector to detect a temperature of a center portion of the rotary heat generator, wherein, after the first image formation job is completed, the fixer controller adjusts the temperature of the center portion of the rotary heat generator detected by the first temperature detector to the first predetermined temperature by controlling the activation of the excitation coil as well as the demagnetization coil.

11. The image forming apparatus according to claim 1, wherein, after the first image formation job is completed, the fixer controller reduces the temperature of the end portion of the rotary heat generator by controlling the activation of the excitation coil as well as the demagnetization coil.

12. The image forming apparatus according to claim 1, wherein the activation of the excitation coil is controlled via pulse width modulation (PWM) of a switching member.

13. The image forming apparatus according to claim 1, wherein the activation of the excitation coil as well as the demagnetization coil is controlled through proportional-integral-derivative (PID) control.

14. The image forming apparatus according to claim 1, wherein, when a number of sheets continuously fed to the fixer in the first image formation job exceeds a predetermined number, the activation of the excitation coil as well as the demagnetization coil is controlled after the first image formation job is completed.

15. The image forming apparatus according to claim 1, wherein, when the activation of the excitation coil as well as the demagnetization coil is controlled after the first image formation job is completed, a switch of the demagnetization coil is driven at a duty ratio identical to that in the first image formation job.

16. The image forming apparatus according to claim 1, wherein the demagnetization coil unit includes a plurality of demagnetization coils to accommodate various different lengths of the sheet in a width direction thereof, at an end portion in the sheet width direction of the fixer.

17. The image forming apparatus according to claim 1, wherein the plurality of demagnetization coils include at least three demagnetization coils.

18. The image forming apparatus according to claim 1, further comprising switches to activate the respective plurality of demagnetization coils, wherein, when a temperature of the end portion is higher than a predetermined temperature, at least one of the switches is selectively turned on, to reduce heat generation in the end portions so as to prevent excessive temperature rise therein.

19. The image forming apparatus according to claim 18, wherein the switches are turned on and off selectively depending on the width of the sheet.

20. A method for controlling an image forming apparatus having a fixer to fix an image on a sheet of recording media, the fixer including:

a rotary heat generator including a heat generation layer;

a pressure member to form a nip with the rotary heat generator to sandwich the sheet therebetween;

an excitation coil disposed facing the rotary heat generator, to inductively heat the heat generation layer; and a demagnetization coil disposed facing the heat generation layer, to generate magnetic flux that partly counteracts magnetic flux generated by the excitation coil, the method comprising:

completing a first image formation job;

detecting a temperature of a center portion and an end portion of the rotary heat generator; and based on the detected temperature, controlling activation of the excitation coil as well as the demagnetization coil before start of a second image formation job following the first image formation job in which an image is formed on a sheet of recording media whose width is smaller than a maximum sheet width usable in the fixer so as to reduce a difference in temperature between the center portion and the end portion of the rotary heat generator.

* * * * *